US012134903B1

(12) United States Patent
Magnusen et al.

(10) Patent No.: US 12,134,903 B1
(45) Date of Patent: Nov. 5, 2024

(54) SUSPENDED TRANSLATING PLATFORM

(71) Applicant: PERI Formwork Systems, Inc., Elkridge, MD (US)

(72) Inventors: David Magnusen, Chicago, IL (US); Mark D Henning, La Grange, IL (US)

(73) Assignee: PERI Formwork Systems, Inc., Elkridge, MD (US)

( * ) Notice: Subject to any disclaimer, the term of this patent is extended or adjusted under 35 U.S.C. 154(b) by 0 days.

(21) Appl. No.: 17/818,252

(22) Filed: Aug. 8, 2022

Related U.S. Application Data

(62) Division of application No. 16/431,733, filed on Jun. 4, 2019, now Pat. No. 11,408,188.

(51) Int. Cl.

| | |
|---|---|
| ***E04G 17/00*** | (2006.01) |
| ***E04G 11/28*** | (2006.01) |
| ***E04G 11/34*** | (2006.01) |
| ***E04G 17/18*** | (2006.01) |

(52) U.S. Cl.
CPC ..... *E04G 17/002* (2013.01); *E04G 11/28* (2013.01); *E04G 11/34* (2013.01); *E04G 17/18* (2013.01)

(58) Field of Classification Search
CPC ..... E04G 11/28; E04G 11/22; E04G 11/02; E04G 11/24; E04G 17/002
See application file for complete search history.

(56) References Cited

U.S. PATENT DOCUMENTS

| | | | | |
|---|---|---|---|---|
| 1,300,680 | A | 4/1919 | Wilson | |
| 3,563,539 | A | 2/1971 | Rogers | |
| 4,076,778 | A | 2/1978 | Whitting | |
| 4,140,466 | A | 2/1979 | Snow | |
| 4,260,345 | A | 4/1981 | Pettersson | |
| 4,620,702 | A | 11/1986 | Hemmeter | |
| 5,109,953 | A | 5/1992 | Mathis | |
| 5,261,779 | A | 11/1993 | Goodrich | |
| 5,273,415 | A | 12/1993 | Jackson | |
| 6,770,228 | B2 | 8/2004 | Ernst | |
| 7,182,307 | B2 | 2/2007 | Baker | |
| 7,513,480 | B2 | 4/2009 | Bergaretxe | |
| 7,665,712 | B2 | 2/2010 | Stott | |
| 8,016,686 | B2 | 9/2011 | Liggett | |
| 8,020,271 | B2 | 9/2011 | Baum | |
| 8,534,981 | B1 | 9/2013 | Bortz | |
| 8,708,100 | B2 * | 4/2014 | Schwoerer | E04G 11/28 182/20 |
| 9,175,487 | B2 * | 11/2015 | Iturbe Beristain | E04G 21/166 |
| 9,279,260 | B2 | 3/2016 | Baum | |
| 9,611,663 | B2 | 4/2017 | Baum | |
| 10,633,874 | B2 * | 4/2020 | Panseri | E04G 3/28 |
| 10,876,306 | B2 * | 12/2020 | Jackson | E01D 21/00 |
| 2005/0076599 | A1 | 4/2005 | Li | |
| 2009/0173574 | A1 | 7/2009 | Hobmeier | |
| 2013/0341813 | A1 | 12/2013 | Baum | |
| 2017/0254100 | A1 | 9/2017 | Baum | |
| 2018/0313098 | A1 | 11/2018 | Baum | |
| 2018/0334815 | A1 | 11/2018 | Baum | |

FOREIGN PATENT DOCUMENTS

| | | | |
|---|---|---|---|
| FR | 2318289 | A1 | 2/1977 |

* cited by examiner

*Primary Examiner* — Brian E Glessner
*Assistant Examiner* — Daniel J Kenny
(74) *Attorney, Agent, or Firm* — SLEMAN & LUND LLP

(57) ABSTRACT

An external platform that translates such that planking and structural members of the platform remain level and maintain a constant working surface area at the beginning, during, and end of the translation movement.

12 Claims, 25 Drawing Sheets

SUSPENDED TRANSLATING PLATFORM

FIELD OF THE INVENTION

The present application relates to a platform for a self-climbing apparatus used in conjunction with formwork.

BACKGROUND OF THE INVENTION

Certain existing self-climbing systems have external platforms (e.g., outside of the building's core walls) which are suspended from over-wall steel beams that are connected to the system's main structure. These external platforms are typically rigid, meaning that they cannot swing, pivot, or move in or out from the structural wall in any way. The platform's planking is then in a fixed distance (typically 2 inches) away from the concrete wall.

Two problems can arise which present challenges to a rigid external platform. First, when a concrete wall changes thickness, and second, when there are protrusions from the wall, which would conflict with the planking as the system climbs from one level to the next.

The core walls on typical high-rise buildings change in thickness as the building goes up. Walls at the base of the structure must bear the weight of the entire building, and therefore are generally the thickest. As the building goes up, there is less structural load on these walls, and designers commonly reduce the thickness of them for cost saving purposes. This can happen in multiple, small steps or in a few, large steps. Occasionally, walls will be thickened for one or two levels for the purpose of non-typical stiffening or structural reinforcing.

If an external platform system is rigidly attached to the internal formwork system, the distance between the edge of the platform planking and the face of exterior concrete wall are fixed. When walls become thinner, a gap is created between the planking and the wall. Likewise for when walls become thicker, the planking is cut, resulting in a gap between planking and concrete wall in subsequence levels, when the walls step back in. These gaps are typically remedied by the carpenters on the jobsite by various methods. Sometimes planks are nailed down over existing planking to extend the platform. This can result in an un-even work surface and an increased platform weight. Most of the on-site solutions are not an engineered design, and therefore can put the users at risk. No known solution from a formwork manufacturer is currently used to address this problem.

The other problem that exists is a clash between the platform and a protrusion from the wall as the platform is cycled from level to level along its vertical motion path. A vertical motion path is used by every self-climbing formwork system used in construction today.

While protrusions themselves are not a common occurrence, some projects do have them at typical and non-typical levels. Some of the more common wall protrusions are: small slabs cantilevering from the wall and rebar for structurally connecting the slabs to the core. Most of the embedded materials, such as steel embeds, which are used to support precast or structural steel profiles are embedded flush to the form face.

An attempt to solve this problem is described in U.S. Pat. No. 9,611,663 to Baum. Baum discusses external platforms that rotate away from the structure, in various ways, in order to avoid clashing with the rebar. The rotation results in a work surface that is not level. An un-level work surface can be dangerous, or even impossible to work on. Further, Baum describes an implementation in which a portion of the platform folds. This also has the disadvantage of disrupting a working surface associated with the platform.

Another approach is that certain jobsites have removed planking from the platform so as to avoid clashes with the protruding rebar during the climbing process. This planking is then re-installed one the climb is complete. This method, however, is very labor intensive and time consuming, which are both expensive for the contractor. Additionally, by removing planking the workers expose fall hazards for themselves and debris to the jobsite below them. Therefore, this is an unfavorable option.

SUMMARY OF THE INVENTION

The present application overcomes the disadvantages of the prior art by providing a platform that translates such that planking and structural members of the platform remain in the same orientation (e.g., level) at the beginning, during, and end of the translation movement. This results in a much safer platform for construction workers to use as workers could remain on the platform during the movement and any construction debris that is on the platform is not at risk of being dropped on the jobsite below.

The translating motion of this external platform provides a safe, fast, and efficient means to handle common two problems encountered on high-rise construction. In one implementation, the platform remains level at all times (e.g, before, during, and after translation), which means that workers could remain on the platform during climbing, and that construction debris is less likely to fall off the platform onto the workers and pedestrians bellow.

Another advantage is that, in one example, a working surface associated with the platform maintains a constant area at all times (e.g., before, during, and after translation), which means that safety handrails do not need to be relocated or altered for the moving process, which makes a safer work environment. Additionally material and equipment that is stored on the platform does not have to be relocated, which saves time form the climbing process and labor cost for the contractor.

One aspect of the disclosure provides an external platform system configured for use with a formwork assembly, comprising: a platform configured to support a load; a plurality of linkages attached to the platform and being configured to engage with a support structure; an interlinkage element attached to each of the plurality of linkages such that actuation of the interlinkage element causes translation of the platform.

In one example, a working surface of the platform maintains a constant area before, during, and after the translation.

In one example, the translation of the platform is one of: linear translation; or translation along a translation arc.

In one example, the platform remains level before, during, and after translation.

In one example, the formwork assembly further includes a plurality of formwork elements.

In one example, the system includes a working bracket that anchors to at least one wall section.

In one example, the interlinkage element comprises at least one of: a spindle, a linear actuator, or a hydraulic.

In one example, the interlinkage element is operated manually by a worker on the platform.

In one example, actuation of the interlinkage element comprises lengthening or shortening.

In one example, the plurality of linkages pivotally engage with the support structure.

In one example, the load comprises one or more workers.

Another aspect of the disclosure provides a method of forming a wall section using a formwork assembly and an external platform system, comprising: positioning a connection reinforcement element in a space defined by the formwork assembly; pouring fresh concrete into the space defined by the formwork assembly; adjusting an interlinkage element engaged with a plurality of linkages of the external platform system; in response to the adjustment of the interlinkage element, translating the platform from a first position to a second position such that a working surface of the platform maintains a constant area and the working surface remains level throughout the translation; and climbing the external platform system.

In one example, the first position comprises a working position of the platform and the second position comprises a climbing position of the platform.

In one example, the climbing position is a position in which the connection reinforcement element is not in a vertical climbing path of the platform.

In one example, the first position comprises a working position and the second position comprises a modified working position.

In one example, the method further includes, prior to climbing, translating the platform from the modified working position to the climbing position.

In one example, the translation of the platform is one of: linear translation; or translation along a translation arc.

In one example, adjusting the interlinkage comprises manual adjustment by a worker or automated adjustment.

In one example, the interlinkage element comprises at least one of: a spindle, a linear actuator, or a hydraulic.

In one example, the platform is configured to support a load, the load comprising one or more workers.

BRIEF DESCRIPTION OF THE DRAWINGS

The invention description below refers to the accompanying drawings, of which.

DETAILED DESCRIPTION

Figure 1:
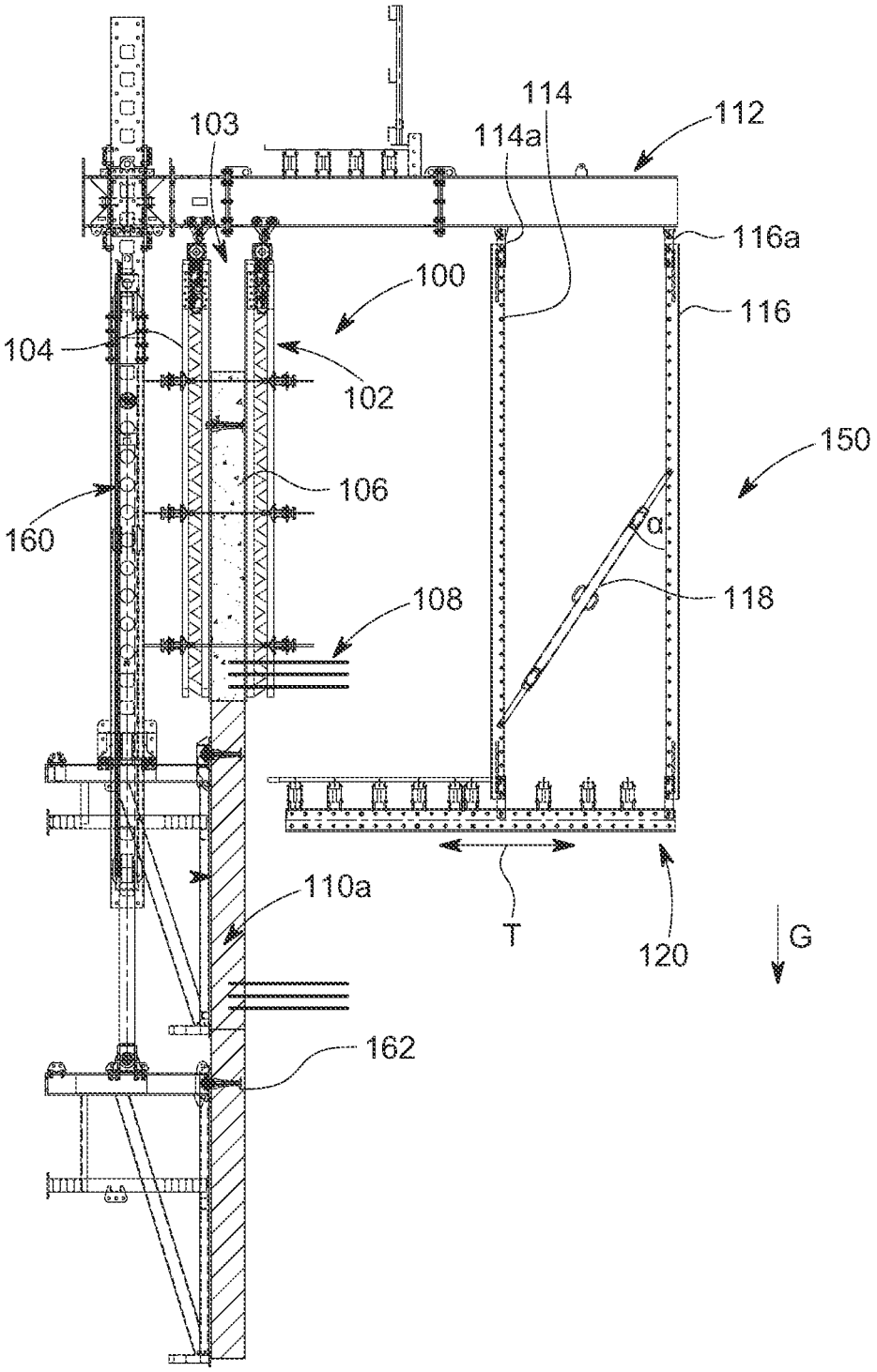
FIG. 1 depicts a pouring concrete stage according to one or more aspects of the disclosure.
Figure 1A:
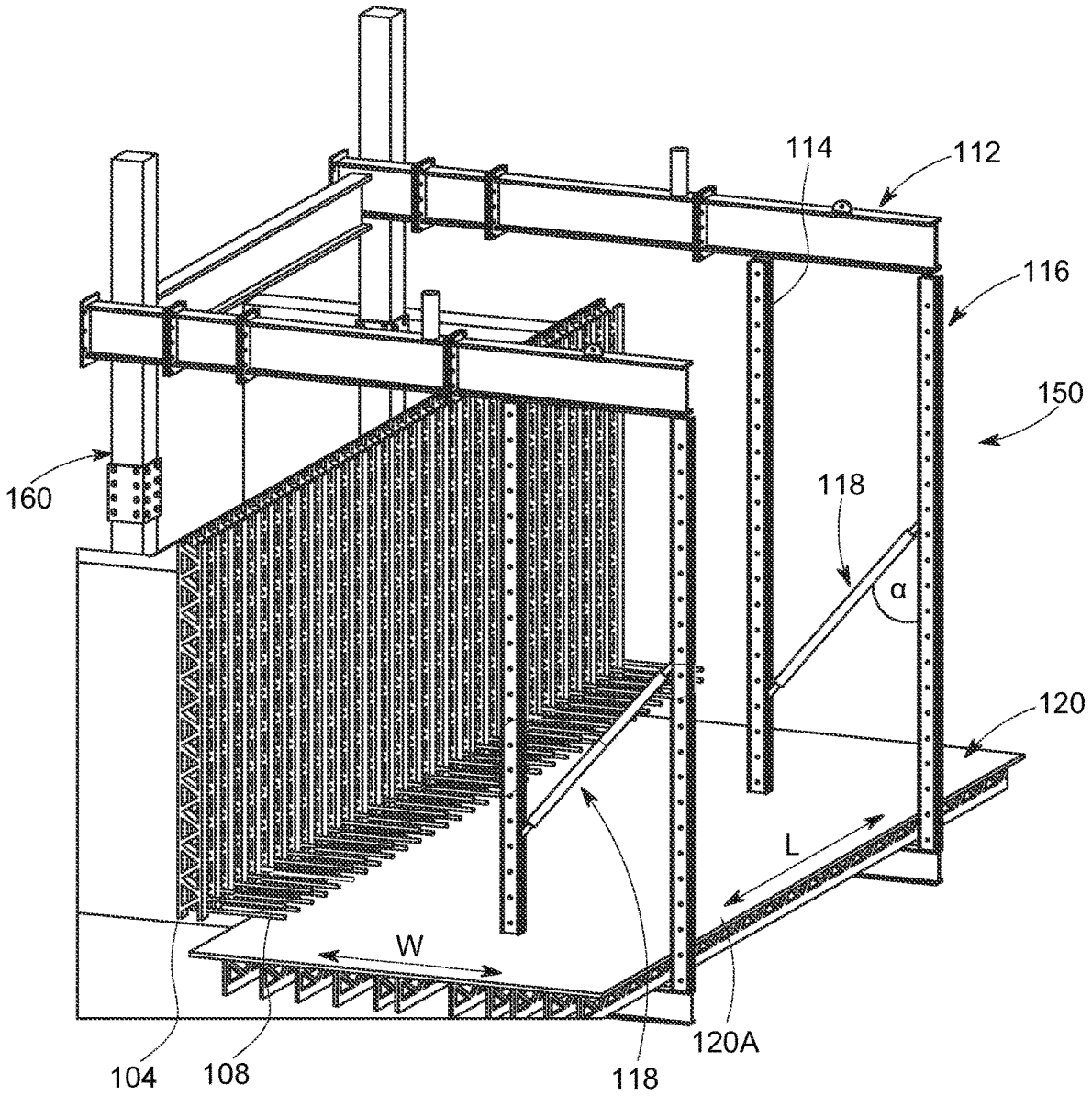
FIG. 1A is a perspective view of the formwork system and the platform system of FIG. 1.

FIGS. 1 to 9 depict various stages of pouring concrete and translating a platform of a self-climbing system according to one or more aspects of the disclosure. FIG. 1 depicts a pouring concrete stage according to one or more aspects of the disclosure, while FIG. 1A is a perspective view of the formwork system and the platform system of FIG. 1.

A formwork system 100 is shown including a first formwork element 102 and a second formwork element 104. The two formwork elements 102 and 104 are situated spaced apart from one another with formwork facings facing one another in their predefined forming position for the wall section to be produced. An intermediate space 103 or free space is formed by the framework facings of the two formwork elements 102 and 104 into which the fresh concrete 106 is to be introduced for producing a vertically extending concrete wall section. The fresh concrete 106 will harden and eventually form a wall section 106*a* atop of existing wall section 110*a*. The wall section 110*a* (and the eventual wall section 106*a* that results from fresh concrete 106) can include one or more protrusions 108, such as one or more connection reinforcement elements (for example reinforcement bar, e.g., rebar), which project away or project outwardly in a direction orthogonal, substantially orthogonal, or any other angular orientation relative to the wall section and which facilitate the connection of a floor (not shown). In one example, the protrusions 108 are rebar and can each have a bow-shaped or U-shaped design known in the building practice. A first and a second arm of each rebar can be connected to one another via a rear section embedded within the fresh concrete 106 and ultimately the wall section 106*a*.

FIG. 1 also depicts an external platform system 150 comprising one or more linkages 114 and 116, an interlinkage connection 118, and a platform 120. In this example, the platform 120 is suspended from one or more overhead support structure(s) 112 (also referred to as gallows beams or support beams) via the one or more linkages 114 and 116, which pivotally engage with the steel beams 112 via pivoting connections 114*a* and 116*a*. The overhead steel beams 112 can be attached to and supported by working bracket 160, which itself can be attached to respective wall sections (e.g., 110*a*) by one or more anchors 162 that are partially or completely embedded within the wall sections themselves. In operation, the platform 120 (and the working surface 120*a*) can support a load(s) during the various stages of pouring concrete and platform translation. The load(s) can include one or more of the following: one or more workers, equipment for use during the stages of pouring, excess or unused materials, or rubbish/waste generated during the process.

The one or more linkages 114 and 116 can be formed of any material, such as steel, aluminum, etc. These linkages typically are constructed out of double c-channel profiles, commonly referred to as walers in the concrete construction industry. The gauge and size of the walers will be dictated by the size and loads imposed on the platform. The linkages 114 and 116 can be connected to the beams 112 via one or more pivoting connections 114*a* and 116*a*. The pivoting connections 114*a* and 116*a* can be pin-type or pin and hole-type. The pivoting connections 114*a* and 116*a* allow for translation of the platform 120 along a translation arc T, which can be substantially toward and away from the formwork system 100. While translation arc T is depicted as a straight line, it is understood that the arc T is an arc by virtue of the pivoting connection of linkages 114, 116 relative to beam 112.

The interlinkage connection 118 can be removably, semi-permanently, or permanently connected to each of linkages 114 and 116 via one or more pins. In the position shown in FIG. 1, the linkages 114 and 116 can be configured at an angle $\alpha$ relative to interlinkage connection, with the angle $\alpha$ being approximately 45 degrees. The interlinkage connection 118 can be any length, and in one example can be in the range of 8 to 9 feet, and in particular can be 8 feet 10.5 inches in the state shown in FIG. 1.

The interlinkage connection 118 can be any type of device capable of linear movement (e.g., linear contraction and linear extension or lengthening). For example, the interlinkage connection 118 can be a linear actuator, a spindle capable of being manipulated manually or automatically actuated, or a hydraulic. In the example of FIG. 1, the interlinkage connection 118 can be a spindle having an adjustable length, such that rotation of a portion of the spindle allows for linear lengthening or linear shortening of the spindle. The interlinkage 118 can include locking threads that prevent unwanted lengthening or shortening of the interlinkage 118 without user manipulation.

As mentioned above, in another example, the interlinkage connection 118 can be a hydraulic element having an adjustable length, with activation of the hydraulic element providing for lengthening or shortening of the element. The activation or actuation can be done by a user positioned on the working surface 120*a* of platform 120 or can be done at a position remote from the platform 120 (e.g., by a user not located on the platform 120).

The platform 120 can be any type of platform suitable for supporting one or more users and any tools or materials used during wall formation. The platform can be any size or shape, and in one example defines a substantially planar rectangular working area 120*a* defined by an area of the rectangular platform (e.g., length (l)×width (w)). The external platform is constructed of a beam or waler that is connected to the linkages. Joists are connected either to the top of, or to the bottom of, this beam, perpendicular to the platform 120. A working surface 120*a* made out of timber planks or plywood is connected to the joists. These material are all rigid members with fixed connections, which create a solid, constant dimensioned working surface.

In FIG. 1, the platform 120 is depicted in a working position (also referred to as a first position). In this position, the platform 120 and the working surface 120*a* are substantially orthogonal to a gravity vector G (i.e., a vector representing a gravitational force acting upon an object with mass by virtue of the earth's gravitational field). In this position, the linkages 114 and 116 are substantially vertical. Stated another way, the linkages 114 and 116 are substantially parallel to the gravity vector.

Figure 2:
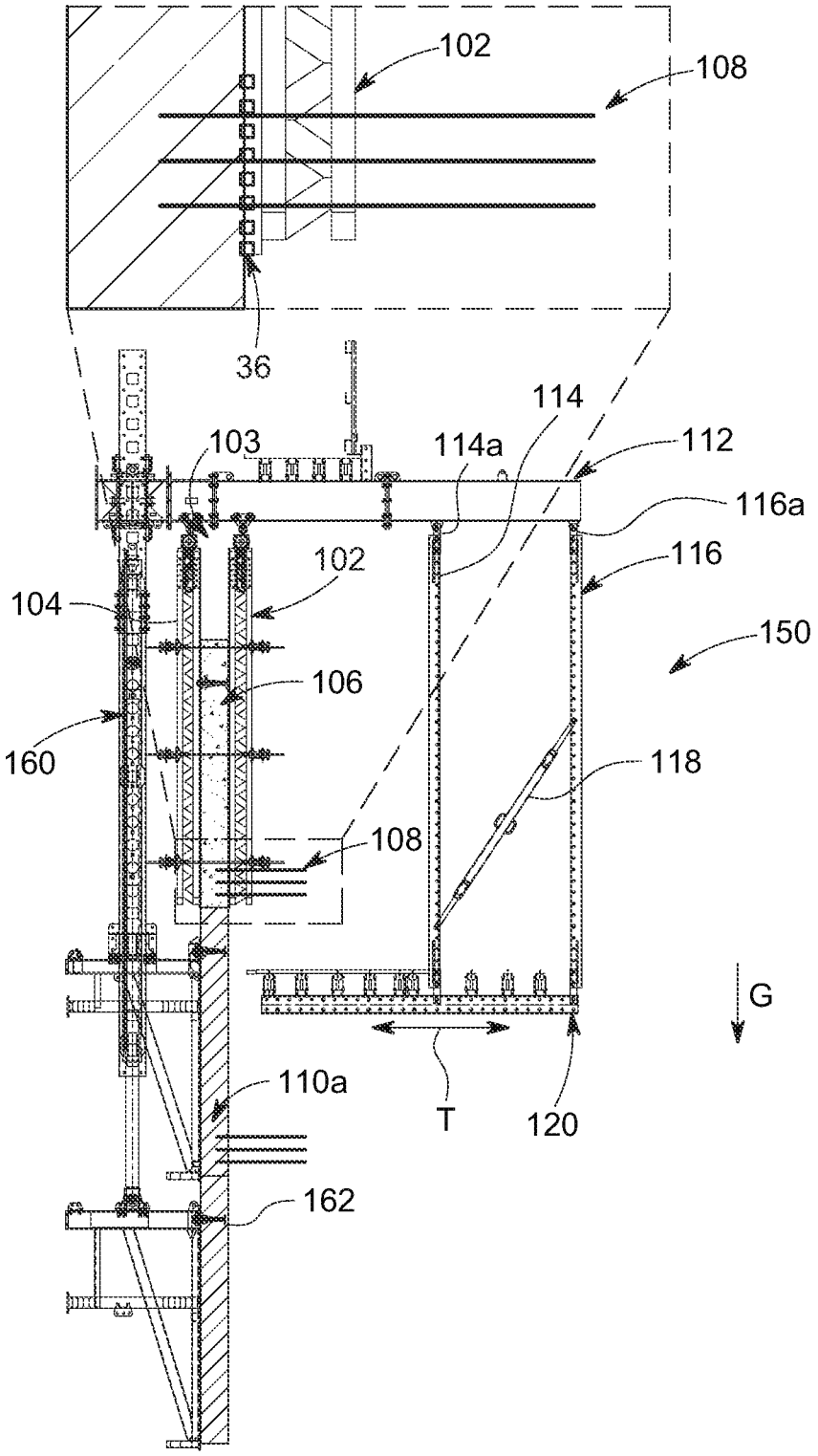
FIG. 2 depicts a stage of internal and external formwork breaking free from concrete.

FIG. 2 depicts internal and external formwork 102, 104 breaking free from concrete. As shown, protrusions 108 protrude from the wall section 106*a* that results from the fresh concrete 106. The protrusions 108 protrude by approximately 3 feet. As shown, the formwork element 102 is translated away from the wall section 106*a* by approximately 1-2 inches. A forming board element 36 remains relatively fixed while the formwork element 102 retracts the approximately 1-2 inches relative to the wall section 106*a*.

Figure 3:
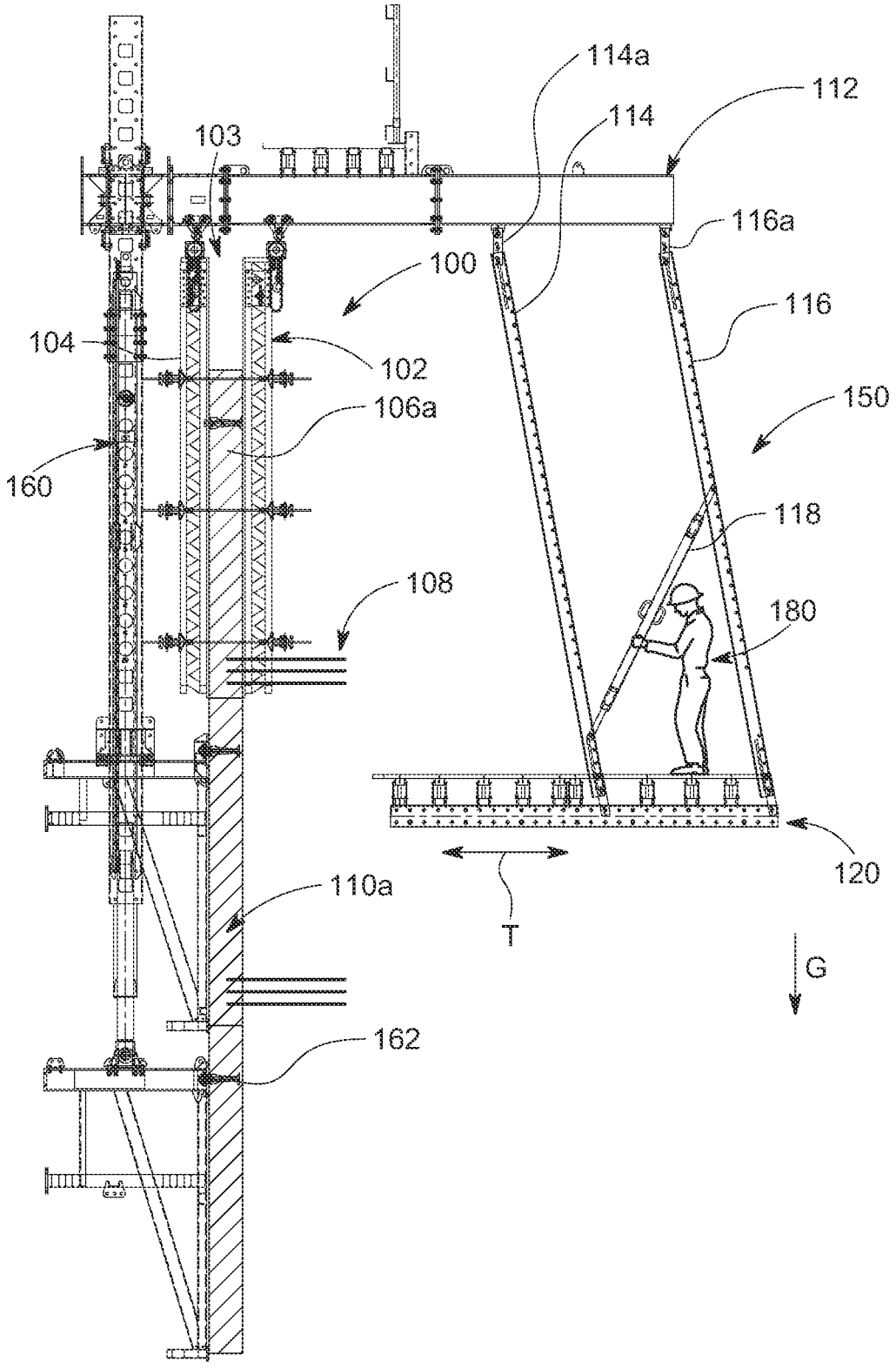
FIG. 3 depicts translation stage of the platform from the working position to a climbing position.

FIG. 3 depicts translation of the platform 120 from the working position to a climbing position (also referred to as a second position or a retracted position). As shown, the worker 180 has actuated (e.g., manipulated by turning or rotating) the interlinkage connection 118 to decrease its overall length (in this example from 8 feet 10.5 inches to approximately 8 feet 1 and ⅜ inches), causing the platform 120 to translate away from the wall sections substantially along the translation arc T. The pivot elements 114*a* and 116*a* allow for synchronized rotational translation of the linkages 114 and 116 relative to the overhead steel beams 112. It should be noted that the translation is substantially along the translation arc T and that the working surface 120*a* of the platform 120 in the climbing position is substantially coplanar with the working surface 120*a* of the platform in the working position depicted in FIGS. 1, 1A, and 2. Stated another way, the working surface 120*a* remains substantially orthogonal to the gravity vector during translation. Stated yet another way, the platform 120 and the working surface 120*a* remain substantially level before, during, and after the translation from the working position to the climbing position. Further, the working surface 120*a* maintains a constant area throughout. In the climbing position, the linkages 114 and 116, while parallel to one another, are no longer parallel to the gravity vector.

The platform 120 is translated away from the wall section 106*a* until the protrusions 108 are not in a vertical climbing path of the platform 120.

Figure 4:
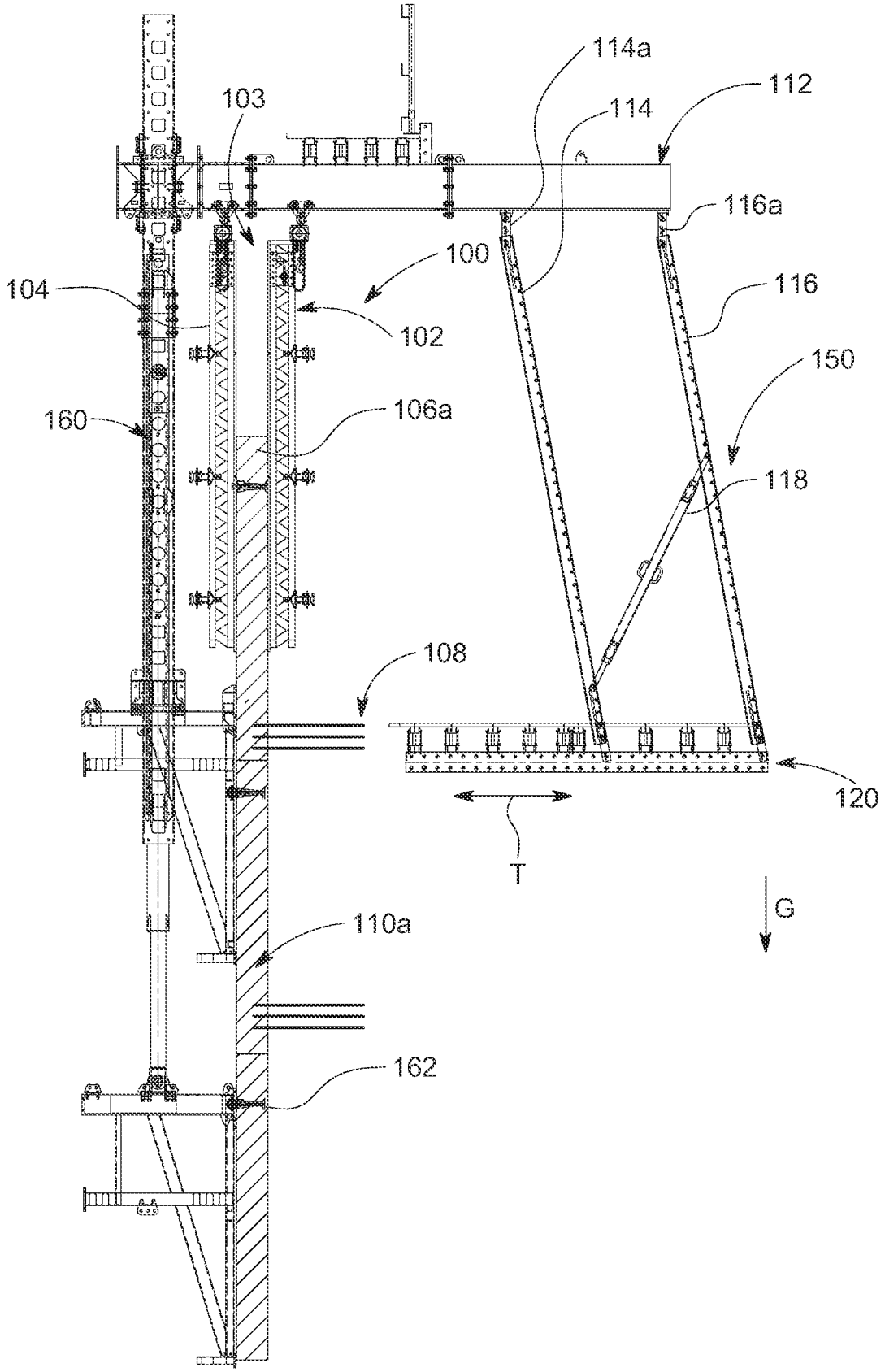
FIG. 4 depicts the climbing system approximately one-third through the climbing process and the platform in the climbing position.

FIG. 4 depicts the climbing system approximately one-third through the climbing process. As shown, the platform 120 is in a climbing position and clears the protrusions 108.

Figure 5:
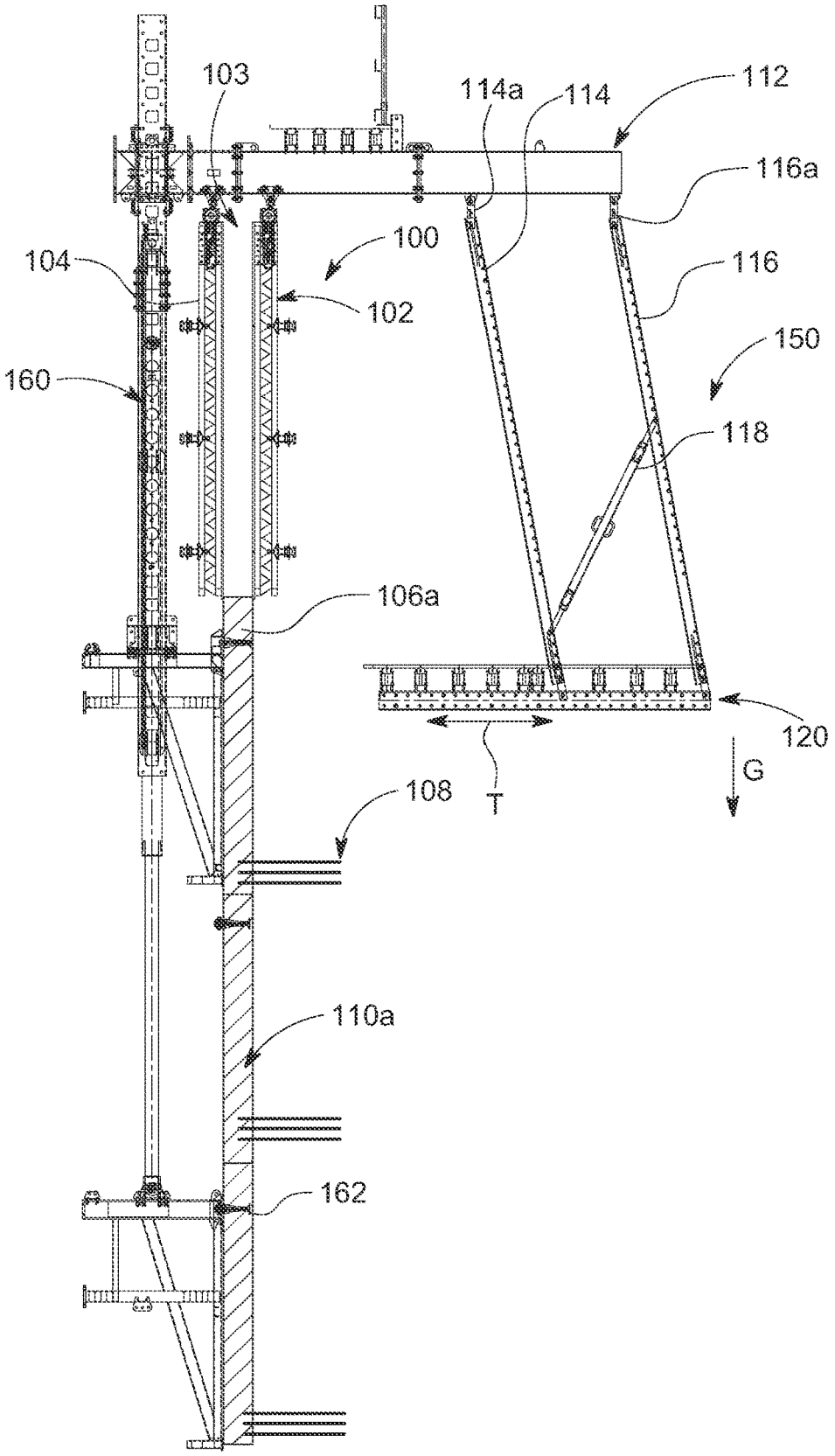
FIG. 5 depicts the climbing system having completed the climbing process and the platform in the climbing position.

FIG. 5 depicts the climbing system having completed the climbing process and the platform 120 in a climbing position. As shown, the platform 120 is in the climbing position and clears the protrusions 108.

Figure 6:
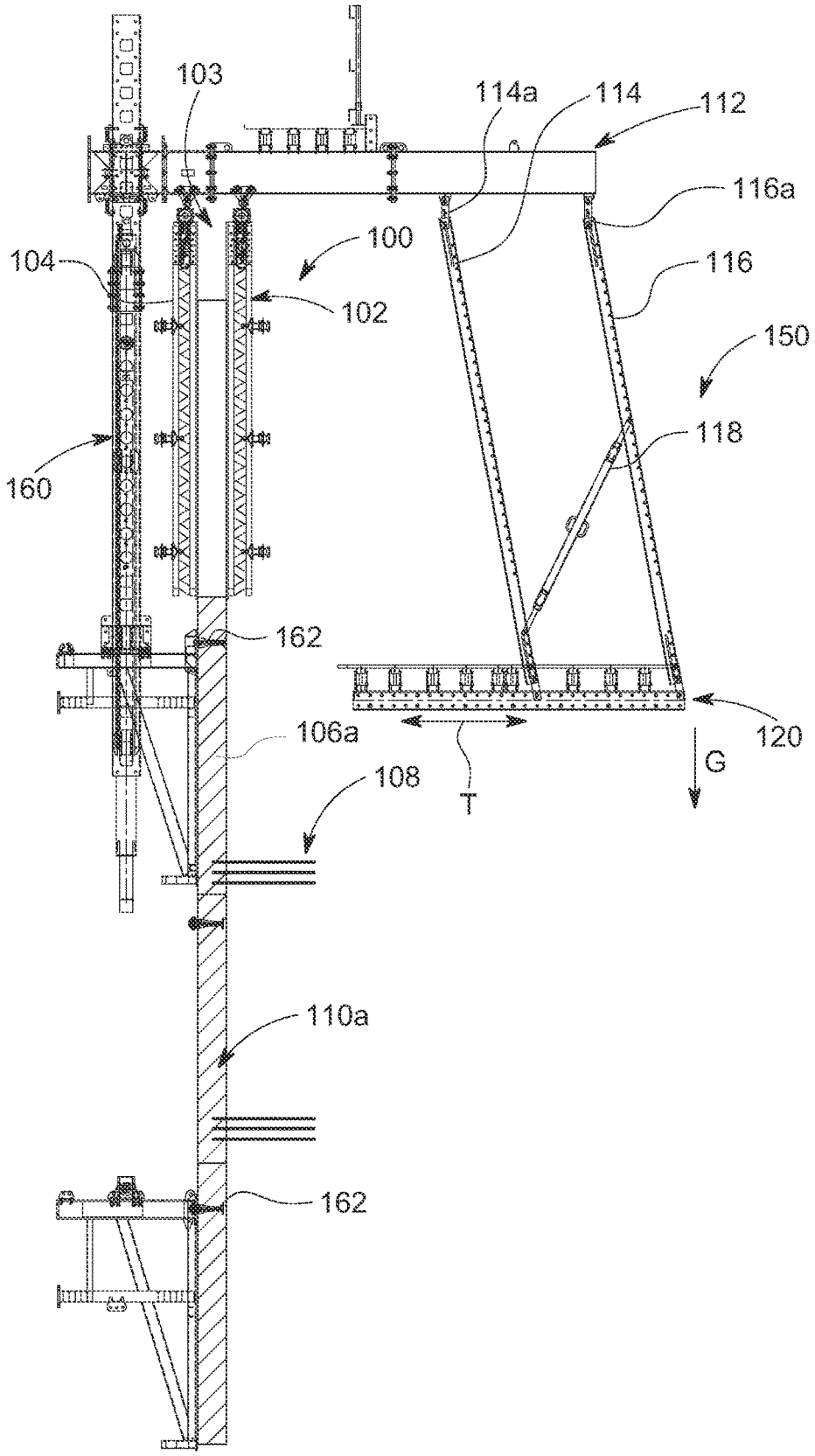
FIG. 6 depicts the working bracket being attached to anchors that were installed into the wall section.

FIG. 6 depicts the working bracket 160, having been removed from wall section 110*a*, being attached to anchors 162 that were installed into the new wall section 106*a*.

Figure 7:
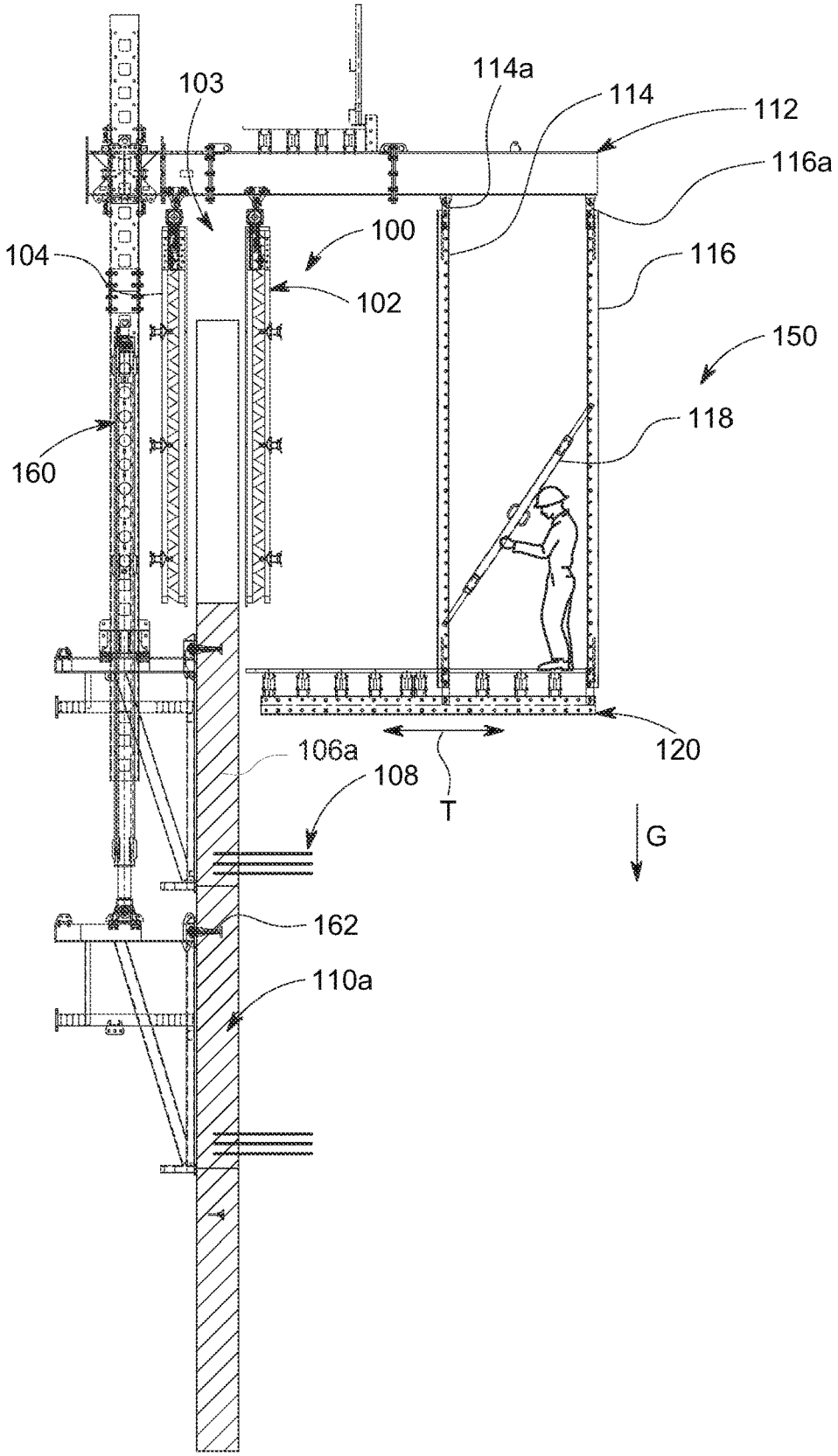
FIG. 7 depicts translation of the platform from a climbing position back to the working position.

FIG. 7 depicts translation of the platform 120 from the climbing position back to the working position. In this regard, actuation of the interlinkage 118 (e.g., lengthening of spindle) causes the platform to translate back to the working position. In doing so, the platform translates substantially along the translation arc T and the working surface 120*a* of the platform 120 is substantially coplanar to the working surface 120*a* shown in the climbing position of FIGS. 3-6. Stated another way, the working surface 120*a* remains substantially orthogonal to the gravity vector during translation from the climbing position back to the working position. Stated yet another way, the platform 120 and the working surface 120*a* are substantially level before, during, and after the translation from the climbing position to the working position. Further, the working surface 120*a* maintains a constant area throughout. In the working position, the linkages 114 and 116 are parallel both to each other and to the gravity vector.

Figure 8:
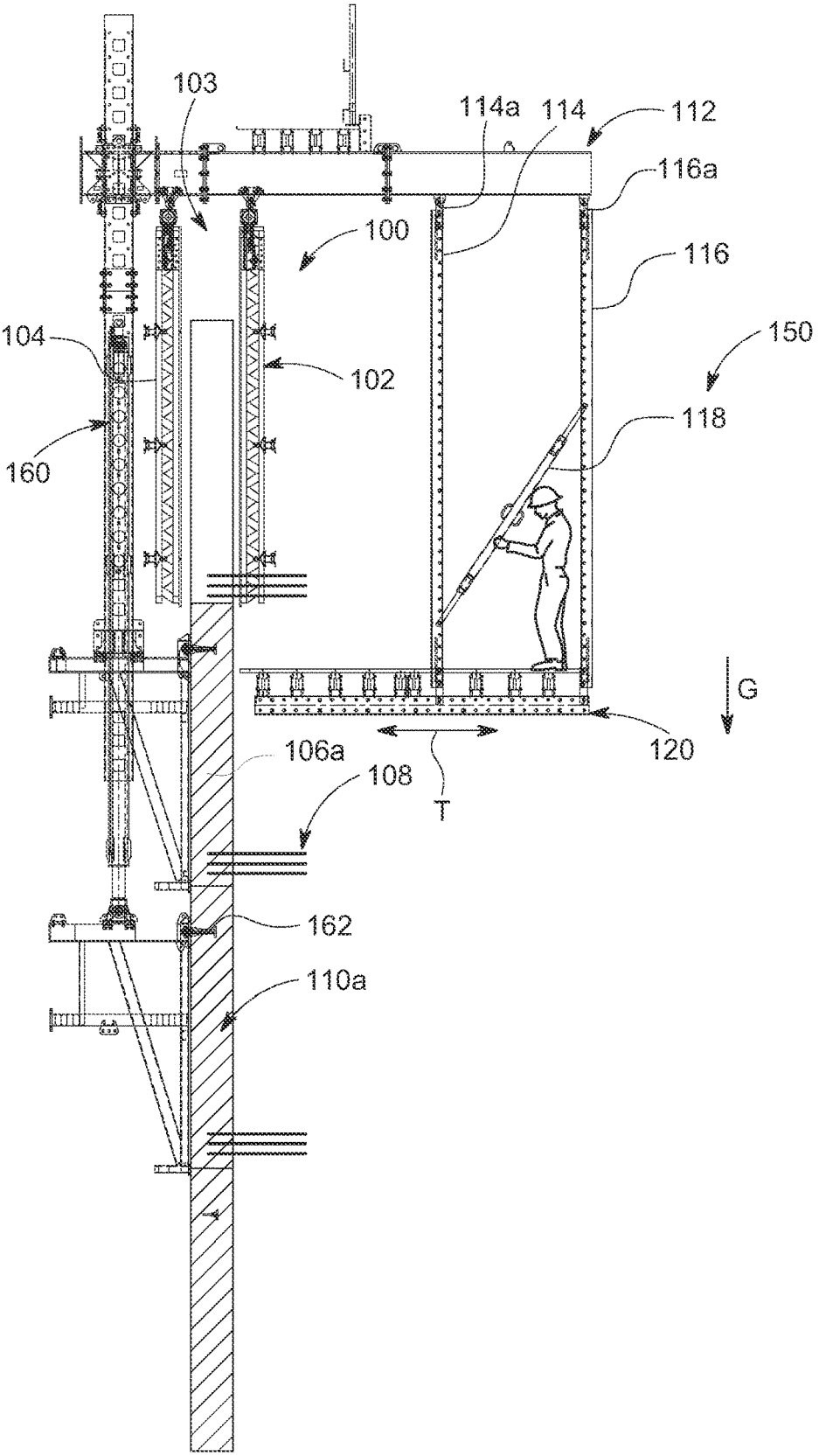
FIG. 8 depicts a preparation of formwork elements and placement of connection reinforcement elements for a subsequent concrete pour.

FIG. 8 depicts a preparation of formwork elements 102, 104 and placement of connection reinforcement elements 108 for a subsequent concrete pour.

Figure 9:
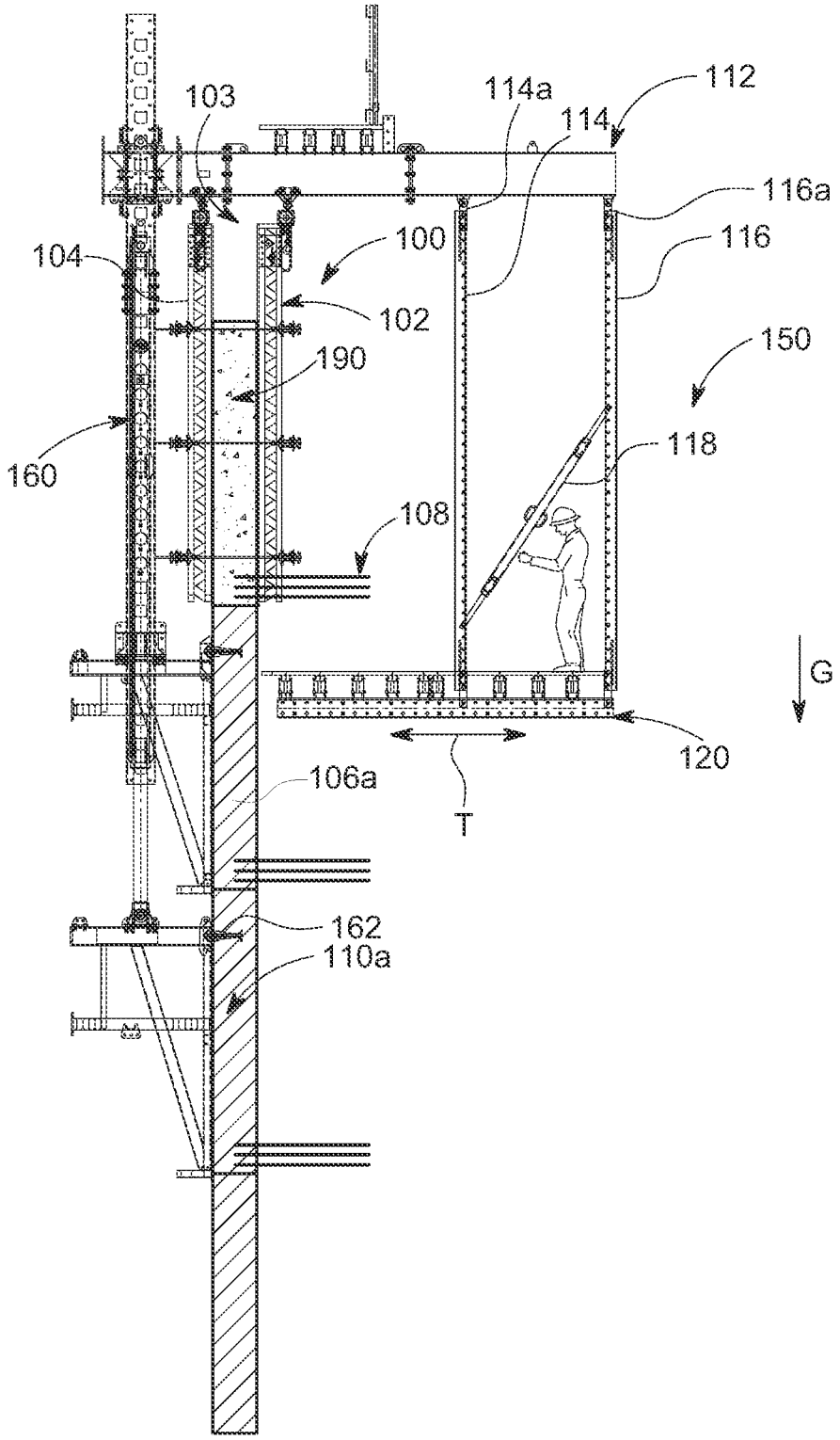
FIG. 9 depicts a subsequent pouring of fresh concrete.

FIG. 9 depicts a subsequent pouring of fresh concrete 190, returning to the stage depicted in FIG. 1.

FIGS. 10-15 depict various stages of pouring concrete for wall sections of varying widths and translating a platform of a self-climbing system according to one or more aspects of the disclosure.

Figure 10:
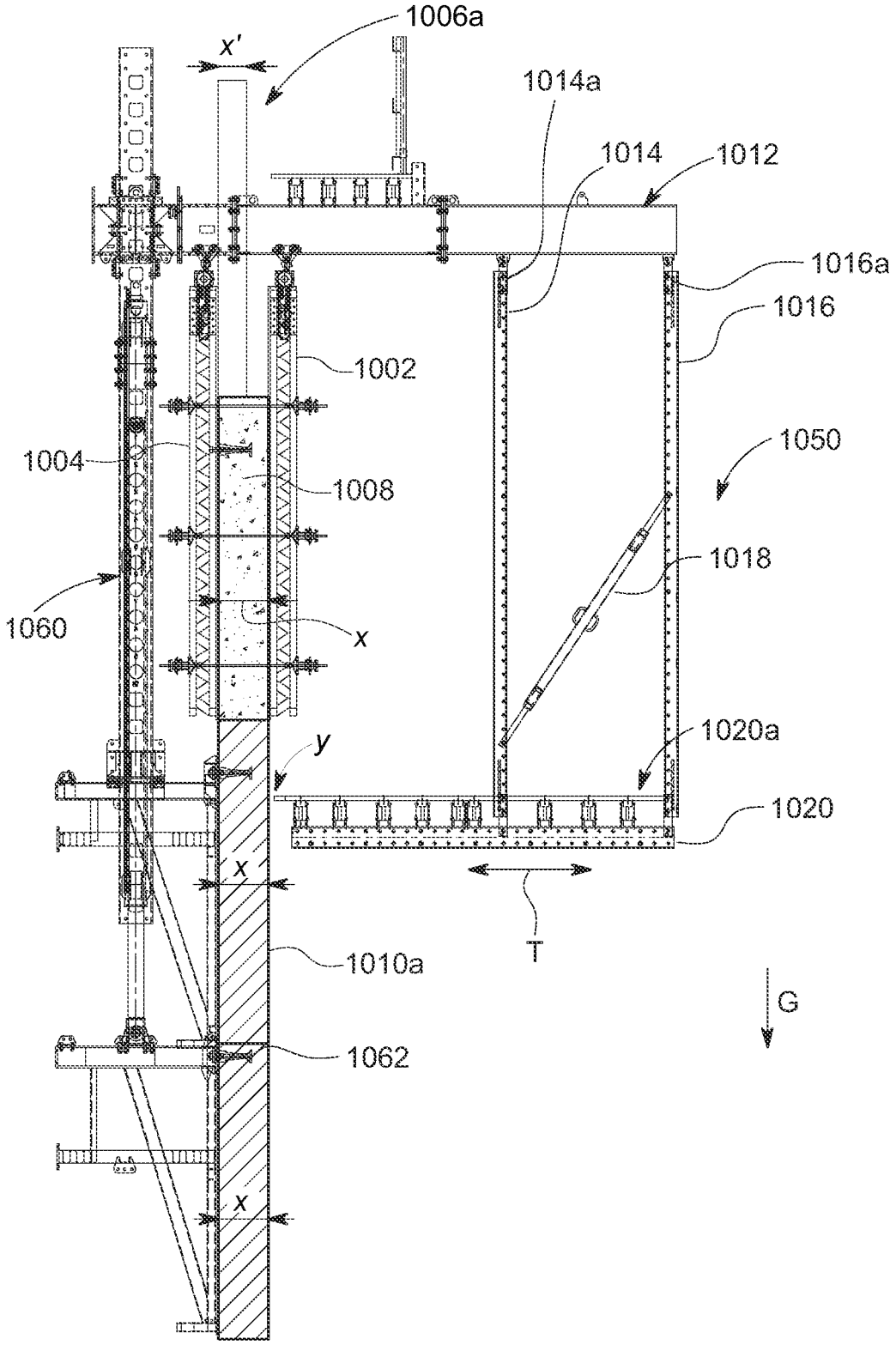
FIG. 10 depicts a pouring concrete stage according to another aspect of the disclosure.

FIG. 10 depicts a formwork assembly 1000 having formwork elements 1002 and 1004 similar to formwork assembly 100 and formwork elements 102 and 104 described above. FIG. 10 also depicts an external platform system 1050 similar to external platform system 150 described above. FIG. 10 also depicts support structure 1060, anchors 1062, linkages 1014, 1016, pivoting connections 1014*a*, 1016*a*, interlinkage 1018, support structure 1012, platform 1020 and working surface 1020*a* similar to the elements described above with respect to FIGS. 1-9.

As shown, there are three proposed wall sections, 1006, 1008*a*, and 1010*a*, with the fresh concrete pour 1008 being depicted in FIG. 10 that will ultimately cure into wall section 1008*a*, and a proposed outline of wall section 1006*a* being depicted (in a state prior to pouring of fresh concrete). Wall sections 1010*a* and 1008 are depicted as having a width x, which can be approximately 20". As also depicted, a gap y exists between wall section 1010*a* and platform 1020 and/or working surface 1020*a*. The gap y is approximately 2 inches.

Figure 11:
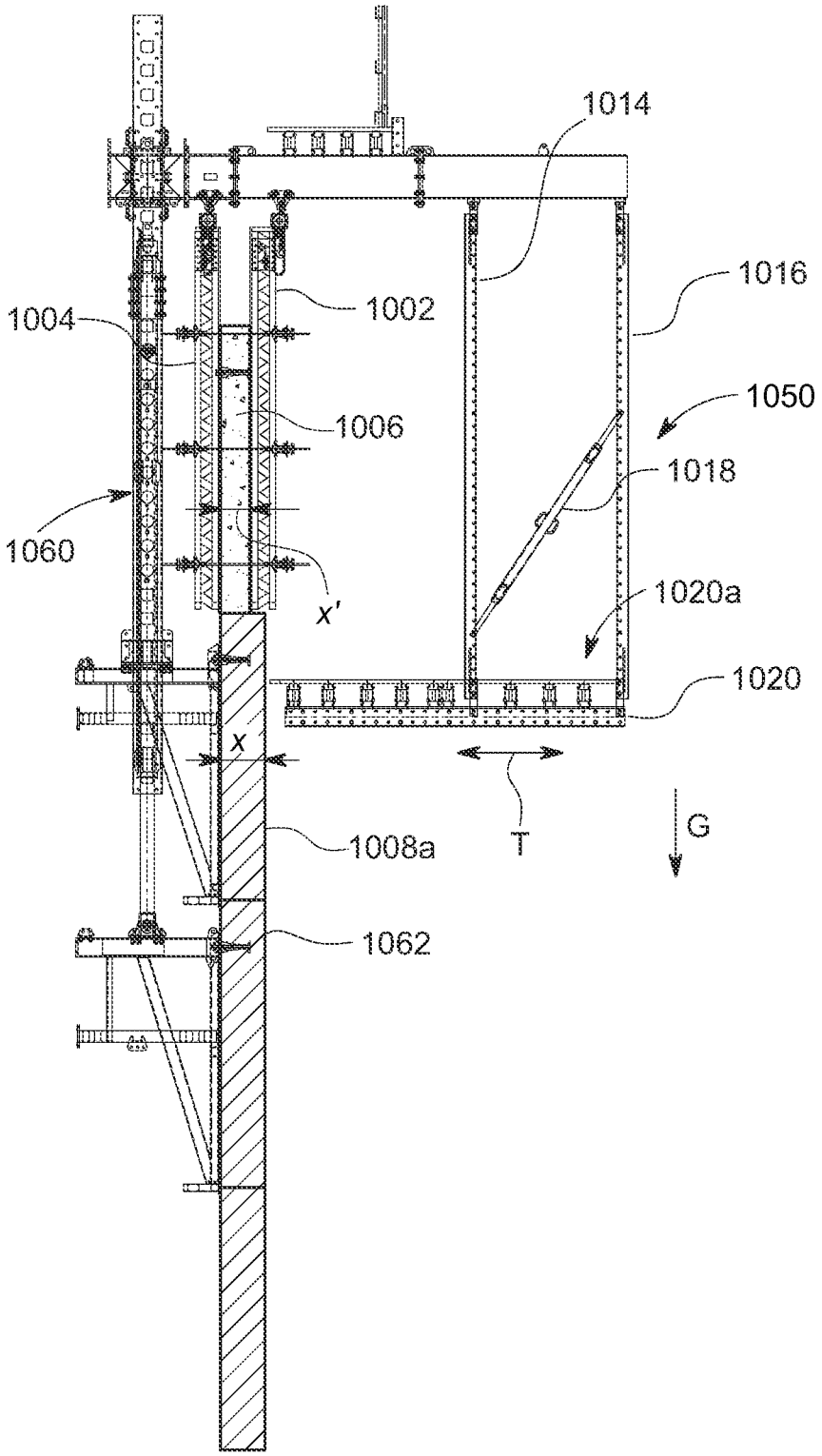
FIG. 11 depicts a stage of internal and external formwork breaking free from a wall section having reduced width.

FIG. 11 depicts a stage where wall section 1008*a* has cured and external platform system 1050 has climbed up to fresh concrete pour 1006 by anchoring to one or more anchors 1062 formed in wall section 1008*a*. A width x' of fresh concrete pour 1006 is less than a width x associated with wall sections 1008*a* and 1010*a*, for example 16".

Figure 12:
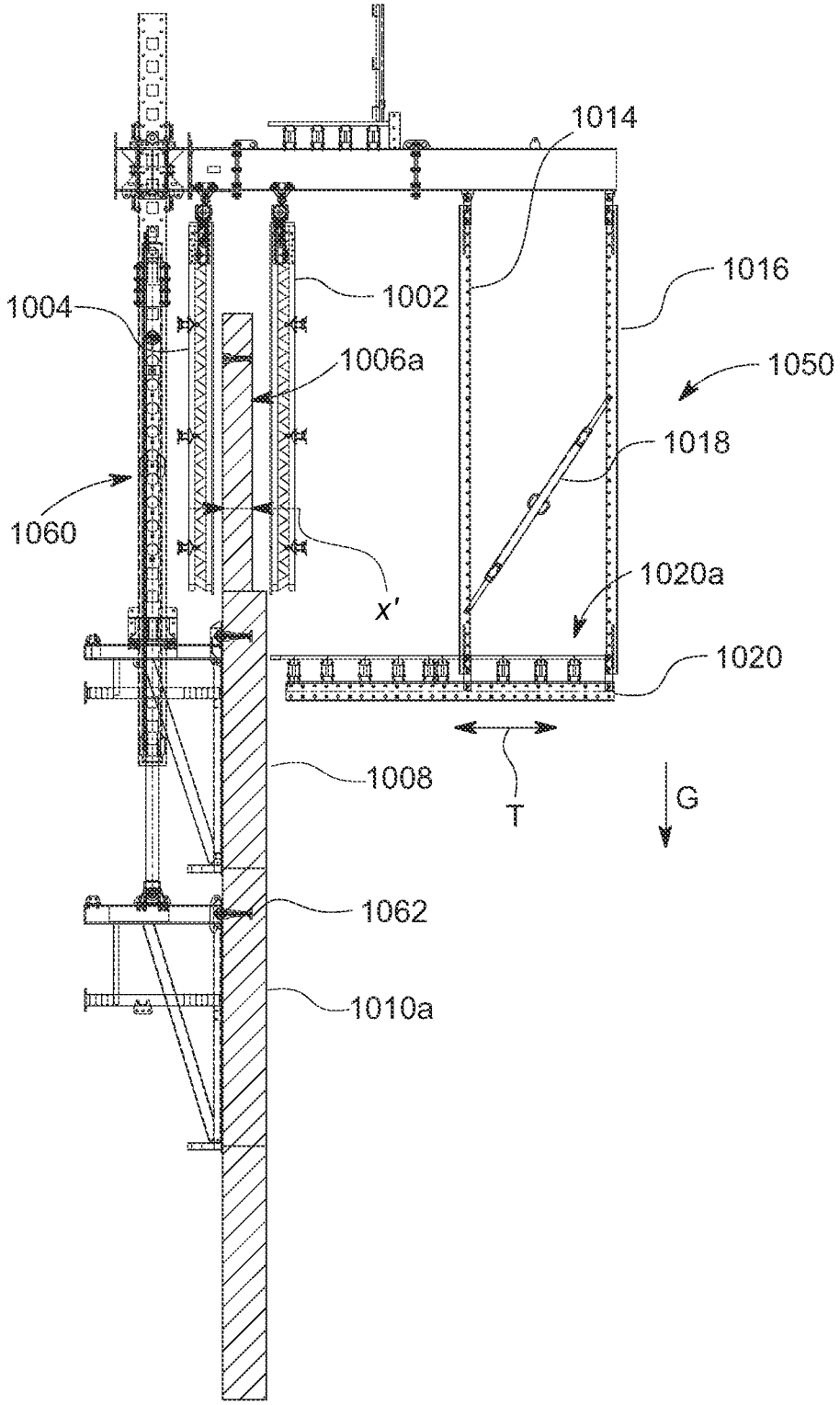
FIG. 12 depicts retracting of formwork elements from the cured wall section having reduced width.

FIG. 12 depicts retracting of formwork elements 1002 and 1004 and the cured wall section 1006*a*, with wall section 1006*a* having a width x' that is less than a width x associated with wall sections 1008*a* and 1010*a*.

Figure 13:
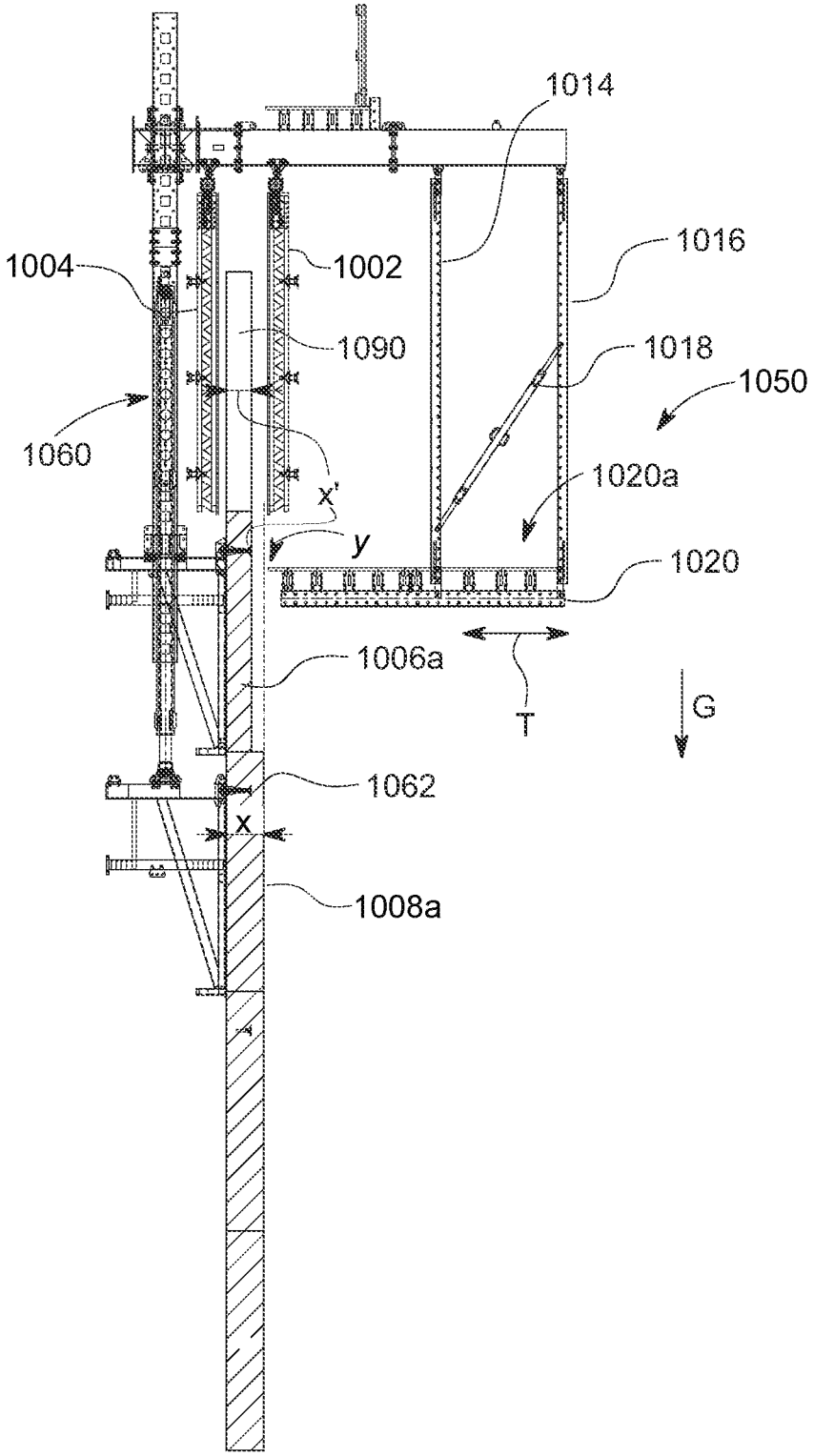
FIG. 13 depicts the external platform system having climbed to reduced width wall section with the formwork elements being prepared for a subsequent reduced width wall section.

FIG. 13 depicts the external platform system 1050 having climbed to wall section 1006*a* with the formwork elements being prepared for a subsequent wall section 1090. In this stage, a distance between the platform 1050 and wall section 1006*a* is defined as y+(x−x'), with y being the original gap defined in FIG. 10, x being the width of wall sections 1008*a* and 1010*a*, and x' being a width of wall sections 1006*a* and 1090*a*. As depicted, this gap is now larger than the stages depicted in FIGS. 10-12 by virtue of the decreased width of wall section 1006*a* relative to wall sections 1008*a* and 1010*a*.

Figure 14:
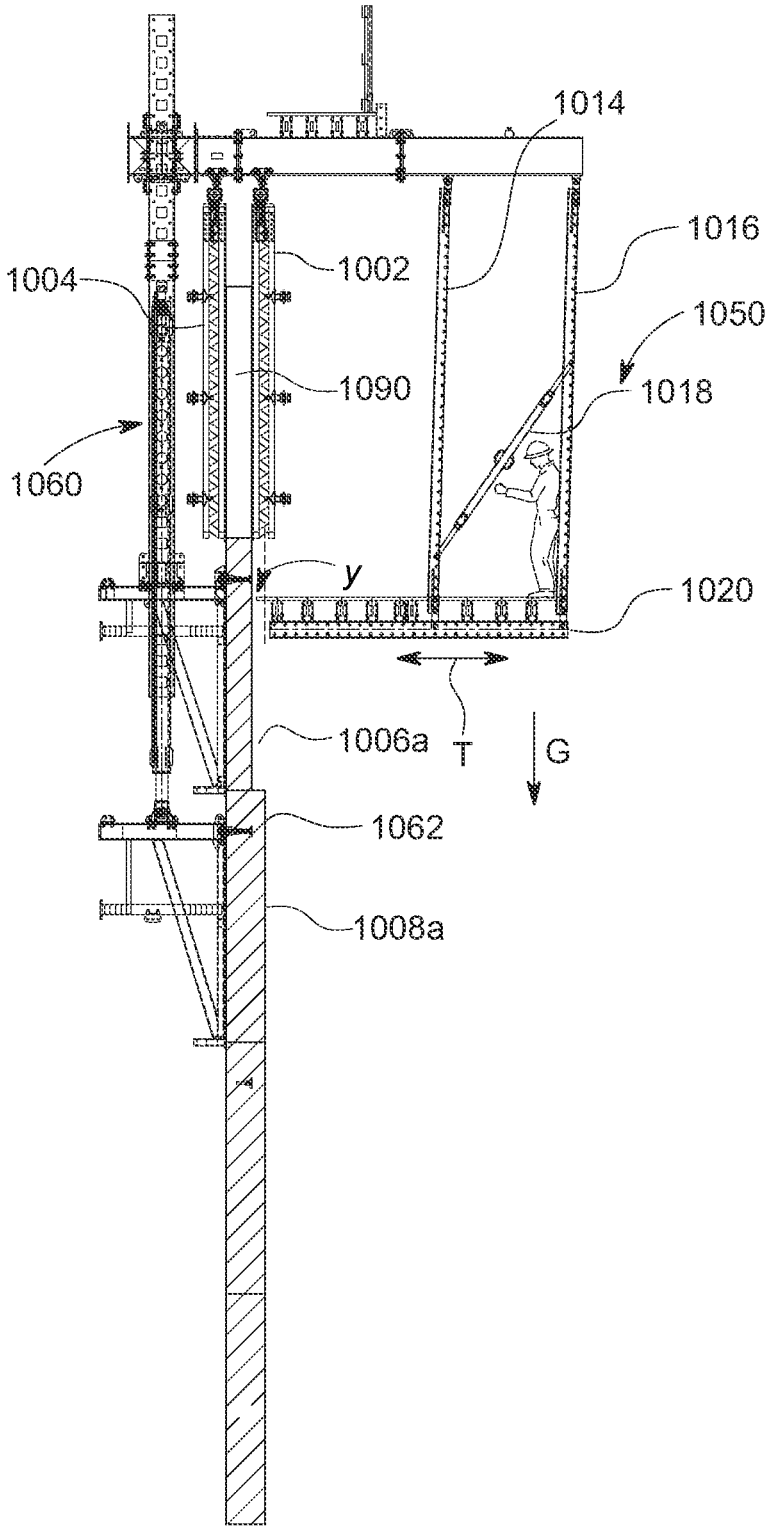
FIG. 14 depicts translation of the platform toward wall section from the working position to a modified working position.

FIG. 14 depicts translation of the platform 1020 toward wall section 1006*a* from the working position to a modified working position. This is accomplished by actuating (e.g., extending) the interlinkage element 1018 between linkages 1014 and 1016 (connected to support 1012 via pivoting connections 1014*a*, 1016*a*), providing for translation of the platform 1020 substantially along the translation arc T such that the working surface 1020*a* of platform 1020 depicted in FIGS. 10-13 is substantially coplanar with the working surface of platform 1020 depicted in FIG. 14. Stated another way, the working surface 1020*a* remains substantially orthogonal to the gravity vector during translation from the climbing position back to the working position. Stated another way, the working surface 1020*a* remains substantially level before, during, and after translation. Here, a gap between the platform 1020 and the wall section 1006*a* is reduced to y by virtue of the translation of the platform.

Figure 15:
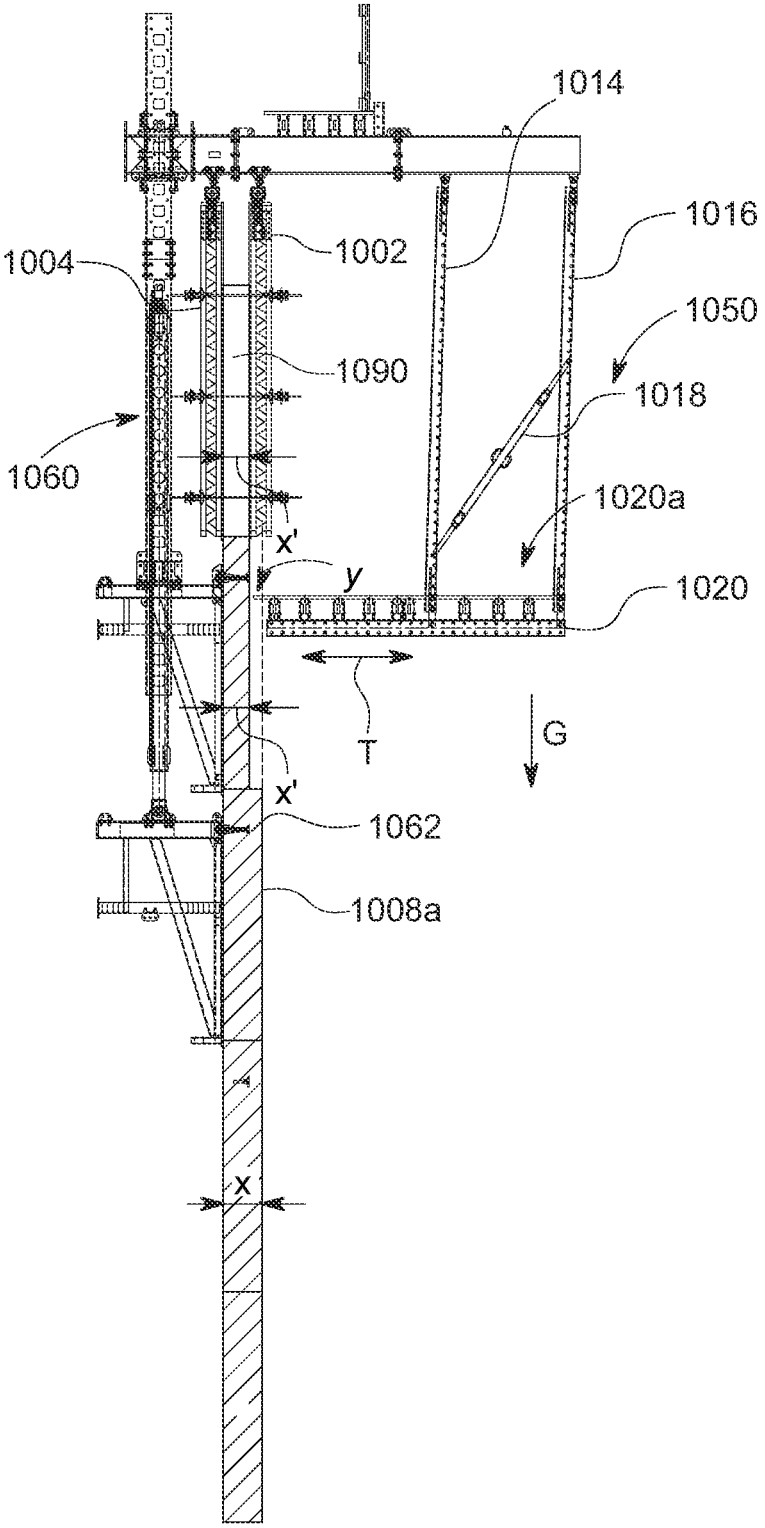
FIG. 15 depicts pouring of the subsequent reduced width wall section with the platform in a modified working position.

FIG. 15 depicts pouring of the subsequent wall 1090 section with the platform in a modified working position.

While the examples of FIGS. 10-15 do not depict protrusions, it is contemplated that the system(s), step(s), and/or procedure(s) can operate in an environment where wall sections have both varying widths and protrusions (as shown in FIGS. 1-9).

FIGS. 16-24 depict various stages of pouring concrete for wall sections translating a platform of a self-climbing system according to one or more aspects of the disclosure.

Figure 16:
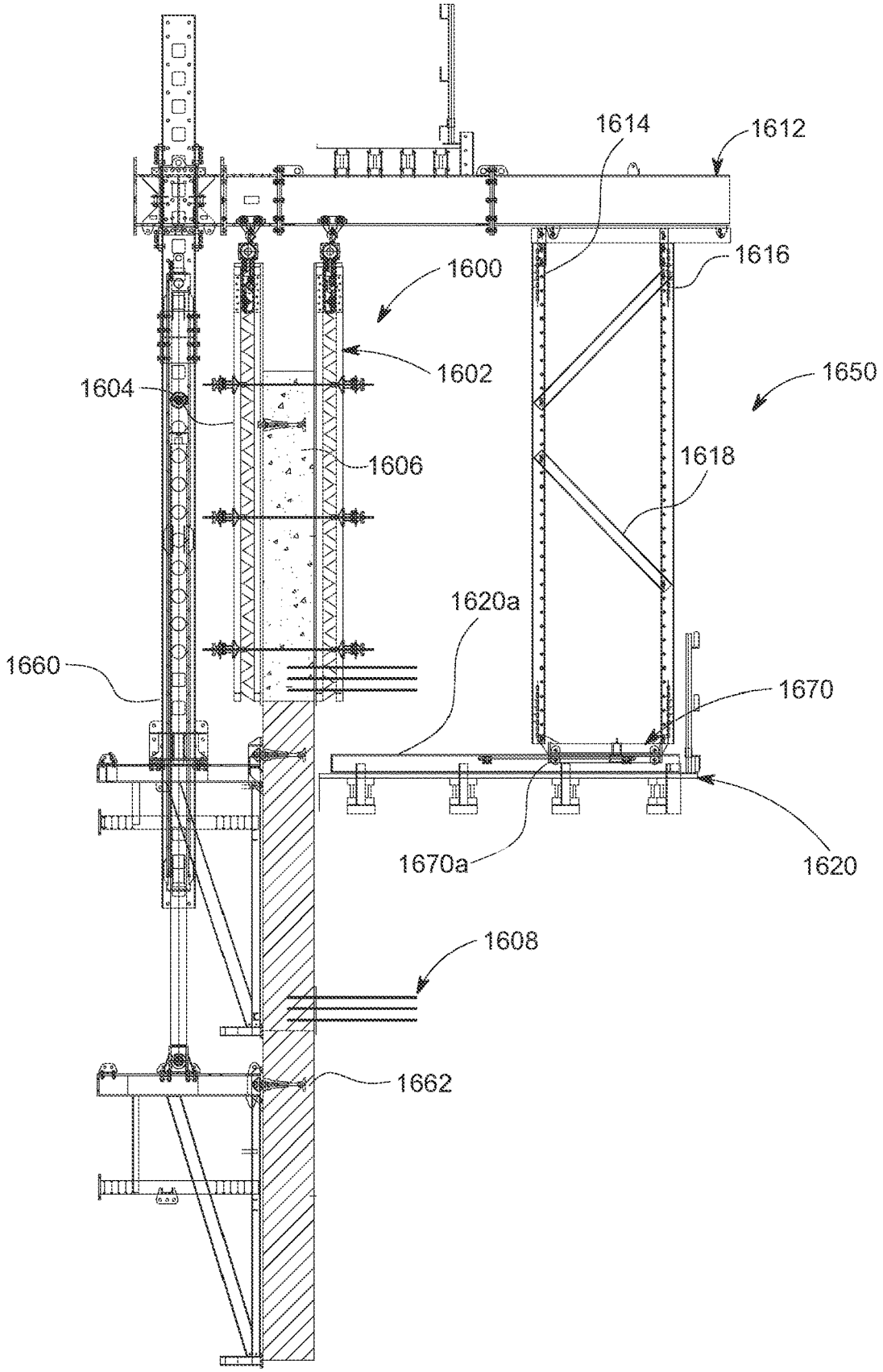
FIG. 16 depicts a pouring concrete stage according another of the disclosure.

FIG. 16 depicts a formwork assembly 1600 having formwork elements 1602 and 1604 similar to formwork assembly 100 and formwork elements 102 and 104 and formwork assembly 100 and formwork elements 1002 and 1004 described above. FIG. 10 also depicts anchors 1662, linkages 1614, 1616, pivoting connections 1614*a*, 1616*a*, support beam 1612, working bracket 1660, platform 1620 and working surface 1620*a* similar to the elements described above with respect to FIGS. 1-9 and FIGS. 10-15. FIG. 16 also depicts an external platform system 1650 capable of lateral translation (i.e. horizontal translation) relative to formwork elements 1602 and 1604 or wall sections 1606*a*, 1610*a*, etc.

As shown in FIG. 16, the formwork system 1600 and the external platform system 1650 are in position for pouring a concrete wall section 1606. The external platform 1620 is suspended from overhead steel beams 1612 (also referred to as gallows beams) via one or more rigid linkages 1614 and 1616 and a carriage 1670. The formwork 1602 and 1604 can also be suspended from the two overhead steel beams 1612. As shown, the concrete can include one or more protrusions 1608 (e.g., connection reinforcement elements). In this example, the linkages 1614 and 1616 are connected to support or steel beams 1612 via a fixed connection such that rotation of the linkages 1614, 1616 is not permitted relative to the beam 1612. At the other end of linkages 1614 and 1616 is the carriage 1670. The carriage 1670 can be fixedly connected to respective ends of the linkages 1614 and 1616 such that that rotation of the linkages 1614 and 1616 is not permitted relative to the carriage 1670. The platform 1620 is then engaged or connected with the carriage 1670. In this regard, the linkages 1614 and 1616 can be considered indirectly engaged with the platform 1620 by way of the intermediate carriage 1670. The carriage 1670 can supports the load(s) of the platform (e.g., one or more workers, equipment, etc.) while providing guidance for its horizontal/translational movement. One or more interlinkage elements 1618 are fixedly connected between the linkages 1614 and 1616. In this regard, rotation of the interlinkage elements 1618 is not permitted relative to the linkages 1614, 1616. In this example, the interlinkage elements 1618 serve to maintain a rigid configuration of the linkages 1614 and 1616 relative to one another.

The interlinkage element(s) 1618 can serve as a drive mechanism that actuates relative motion between the carriage 1670 and the platform 1620. Since the carriage 1670 is fixed relative to the linkages 1614 and 1616, the interlinkage 1618 drive mechanism can provide for lateral translation of the platform 1620 along a track via rollers 1670*a*. The drive mechanism can be any mechanical arrangement that allows for lateral translation of the platform 1620, such as a spindle, rack & pinion gear drive, threaded rod gear drive, hydraulic cylinder.

Figure 17:
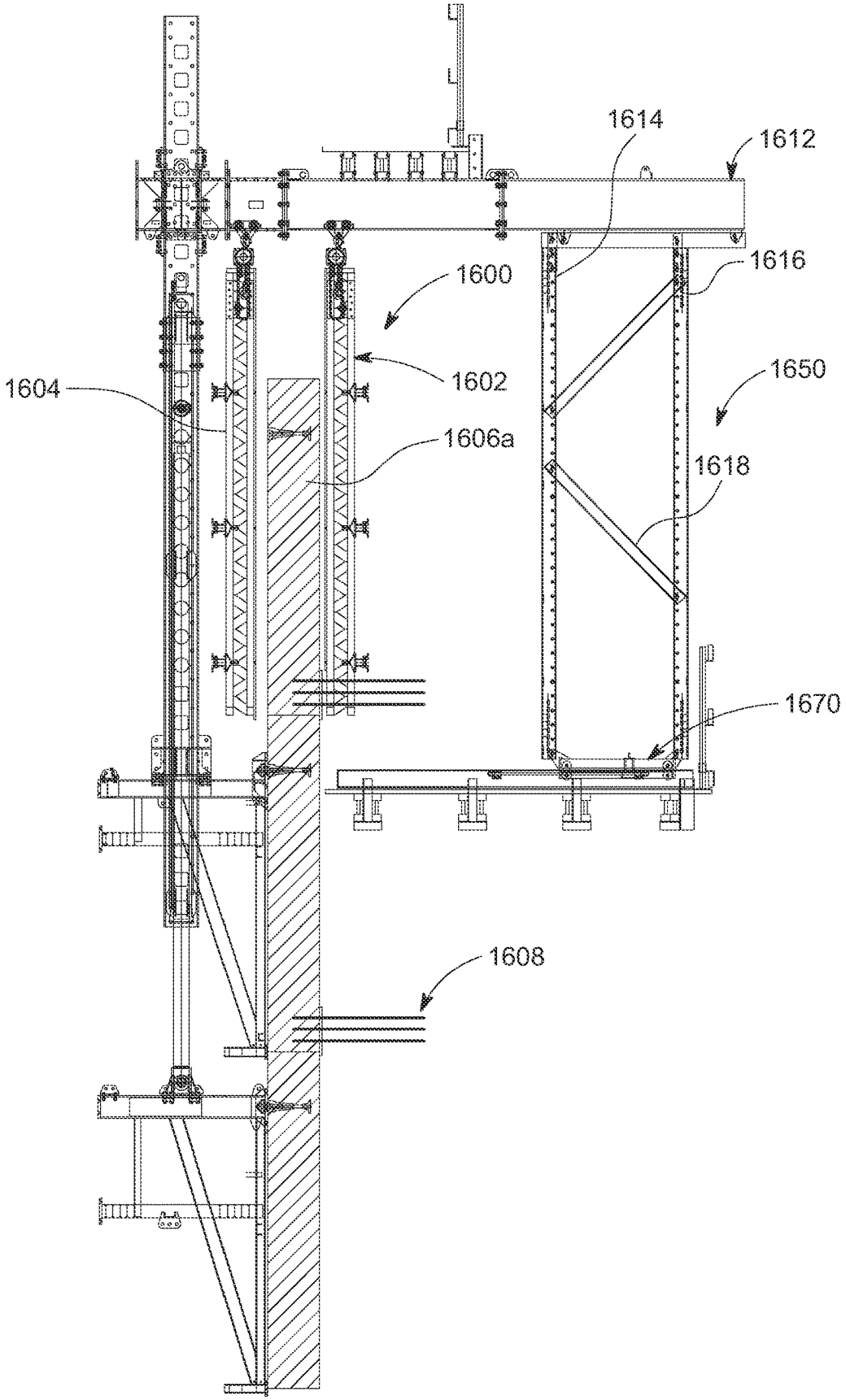
FIG. 17 depicts a stage of internal and external formwork breaking free from concrete.

FIG. 17 shows the protrusion 1608, e.g., connection reinforcement element or rebar, protruding from the face of wall by a distance of 3'. In this stage, the internal and external formwork 1602 and 1604 break free from the surface of the hardened concrete wall section 1606*a*. In this step, the bond of the cured concrete is released from the plywood on the formwork elements (similar to the stage depicted at FIG. 2). To do this, the formwork elements 1602 and 1604 need only be moved a fraction of an inch away from the wall face of wall section 1606*a*.

Figure 18:
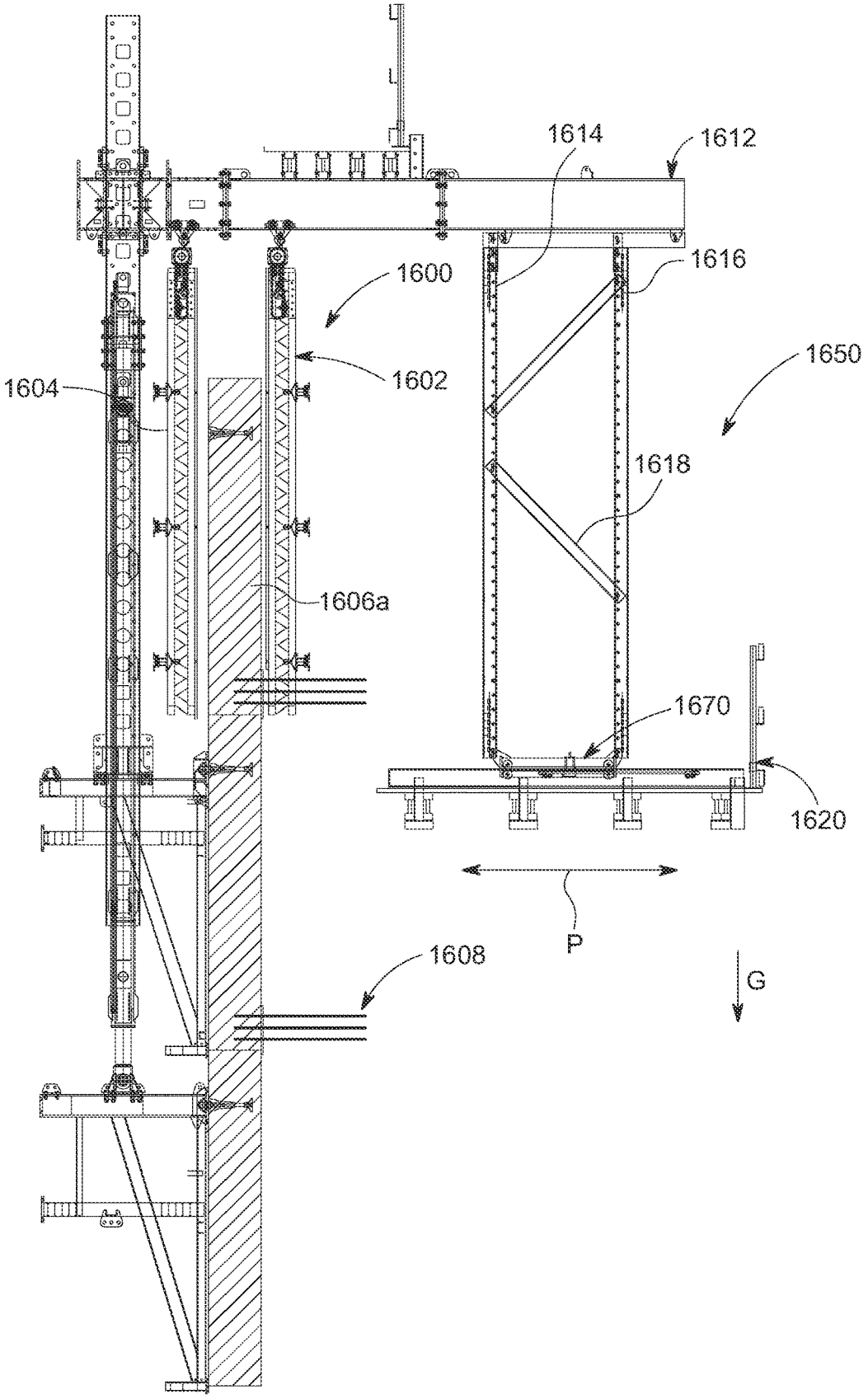
FIG. 18 depicts translation stage of the platform from the working position to a climbing position.

FIG. 18 shows the platform 1620 being translated away from the face of wall section 1606*a* and/or wall section 1610*a* in a linear, horizontal motion path P from the working position of FIGS. 16 and 17. This is achieved by the driving mechanism driving the rollers 1670*a* in the carriage 1670, which support the weight of the platform and its load(s), through which the platform 1620 beam passes. The joists of the platform 1620 are underslung from the platform beam, and the planking is connected to the top of the joists. An operator can manipulate or actuate the interlinkage 1618 to move the platform 1620 through the carriage 1670. In other examples, the platform 1620 can be actuated remotely.

As shown, the translation of the platform 1620 and working surface 1620*a* is substantially along the translation plane T and that the working surface 1620*a* of the platform 1620 in the climbing position is substantially coplanar with the working surface 1620*a* of the platform in the working position depicted in FIGS. 16-17. Stated another way, the working surface 1620*a* remains substantially orthogonal to the gravity vector G during translation. Stated yet another way, the platform 1620 and the working surface 1620*a* remain substantially level before, during, and after the translation from the working position to the climbing position. Further, the working surface 1620*a* maintains a constant area throughout. The platform 1620 is translated away from the wall section 1606*a* until the connection reinforcement elements 1608 are not in a vertical climbing path of the platform 1620.

Figure 19:
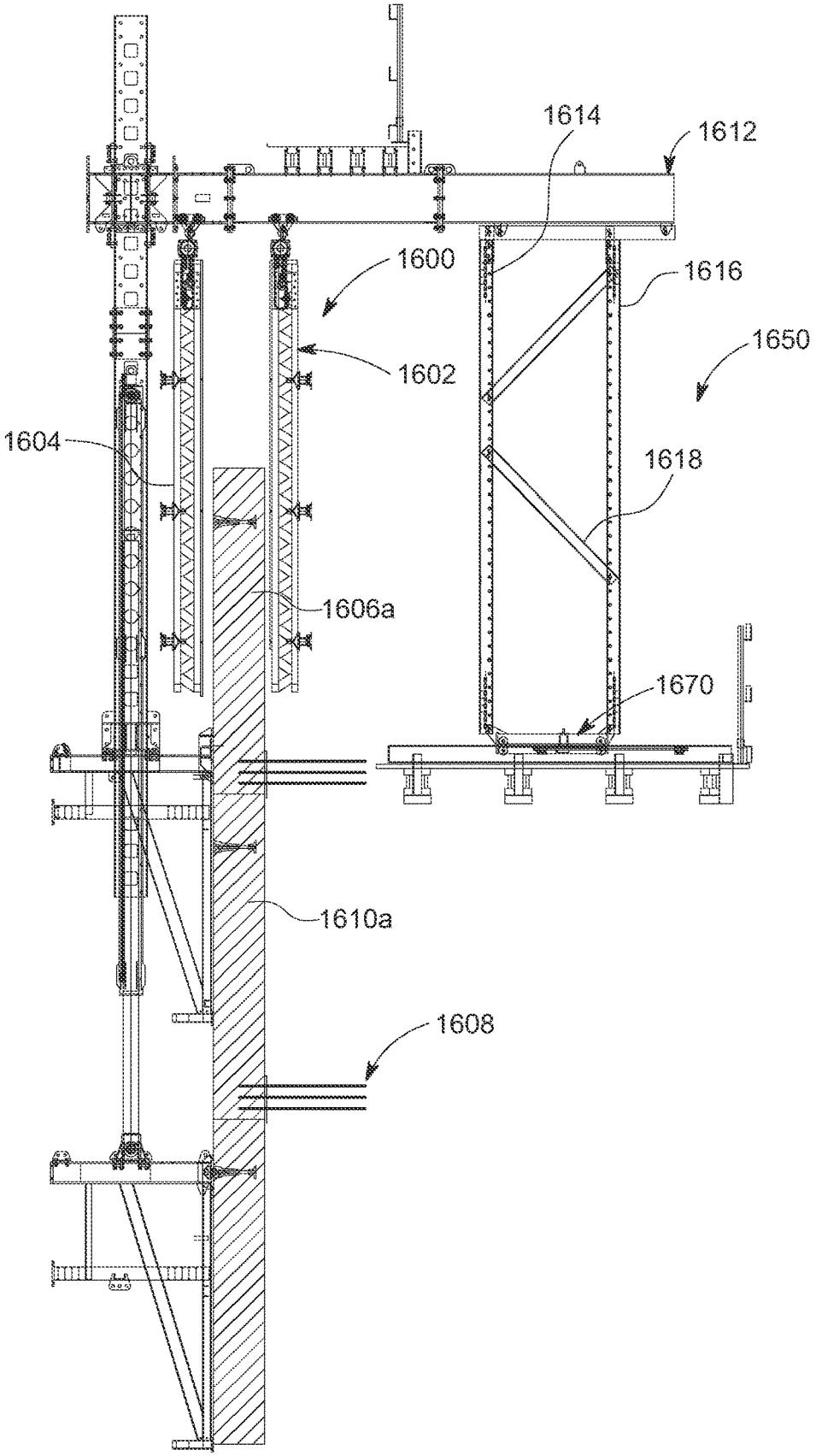
FIG. 19 depicts the climbing system approximately one-third through the climbing process and the platform in the climbing position.

FIG. 19 depicts the climbing system approximately one-third through the climbing process. As shown, the platform 1620 is in a climbing position (also referred to as a retracted position) and clears the protruding connection reinforcement elements 1608.

Figure 20:
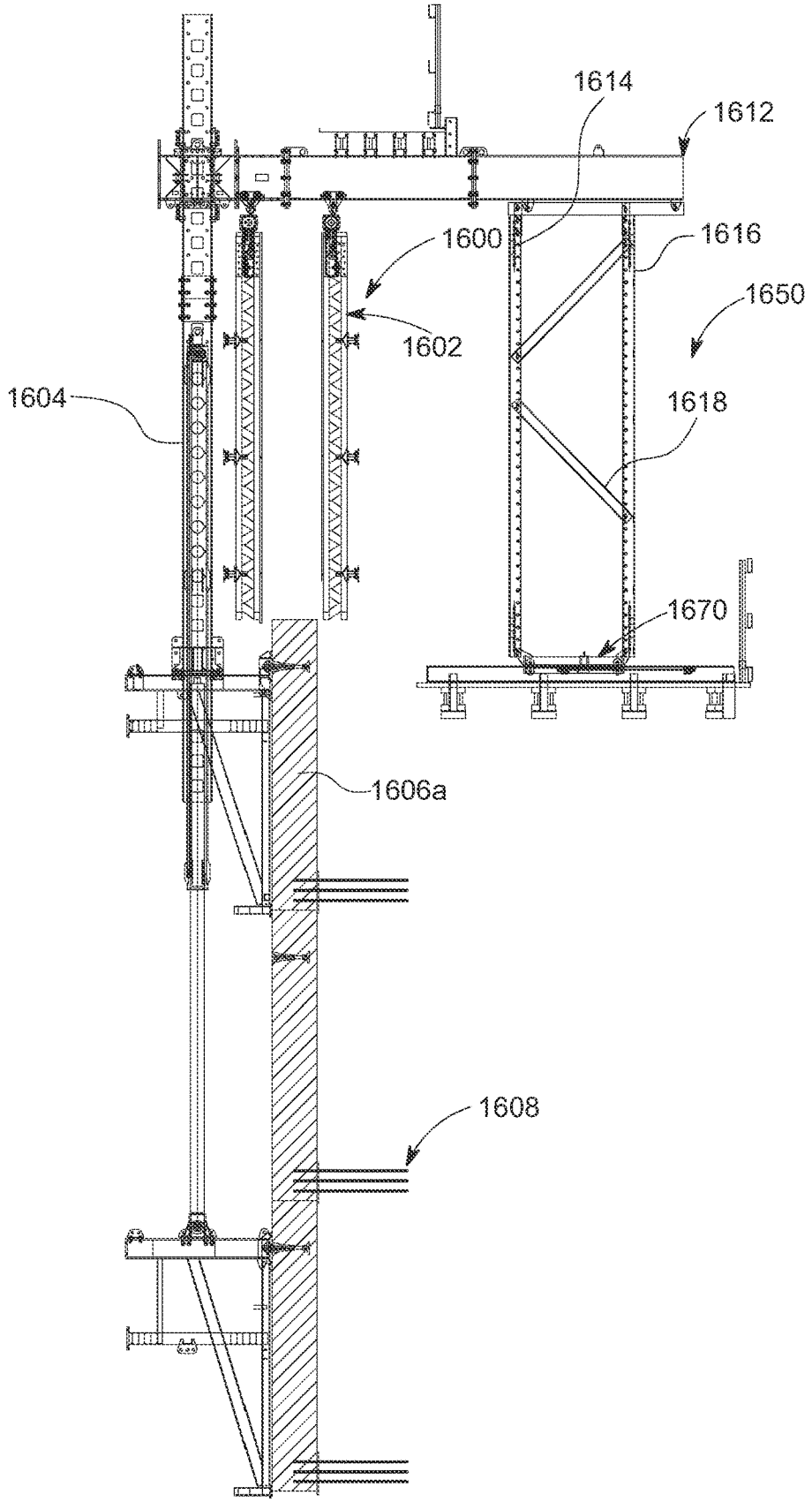
FIG. 20 depicts the climbing system having completed the climbing process and the platform in the climbing position.

FIG. 20 depicts the climbing system having completed the climbing process and the platform 1620 in a climbing position. As shown, the platform 1620 is in the climbing position (or retracted state) and clears the protruding connection reinforcement elements 1608.

Figure 21:
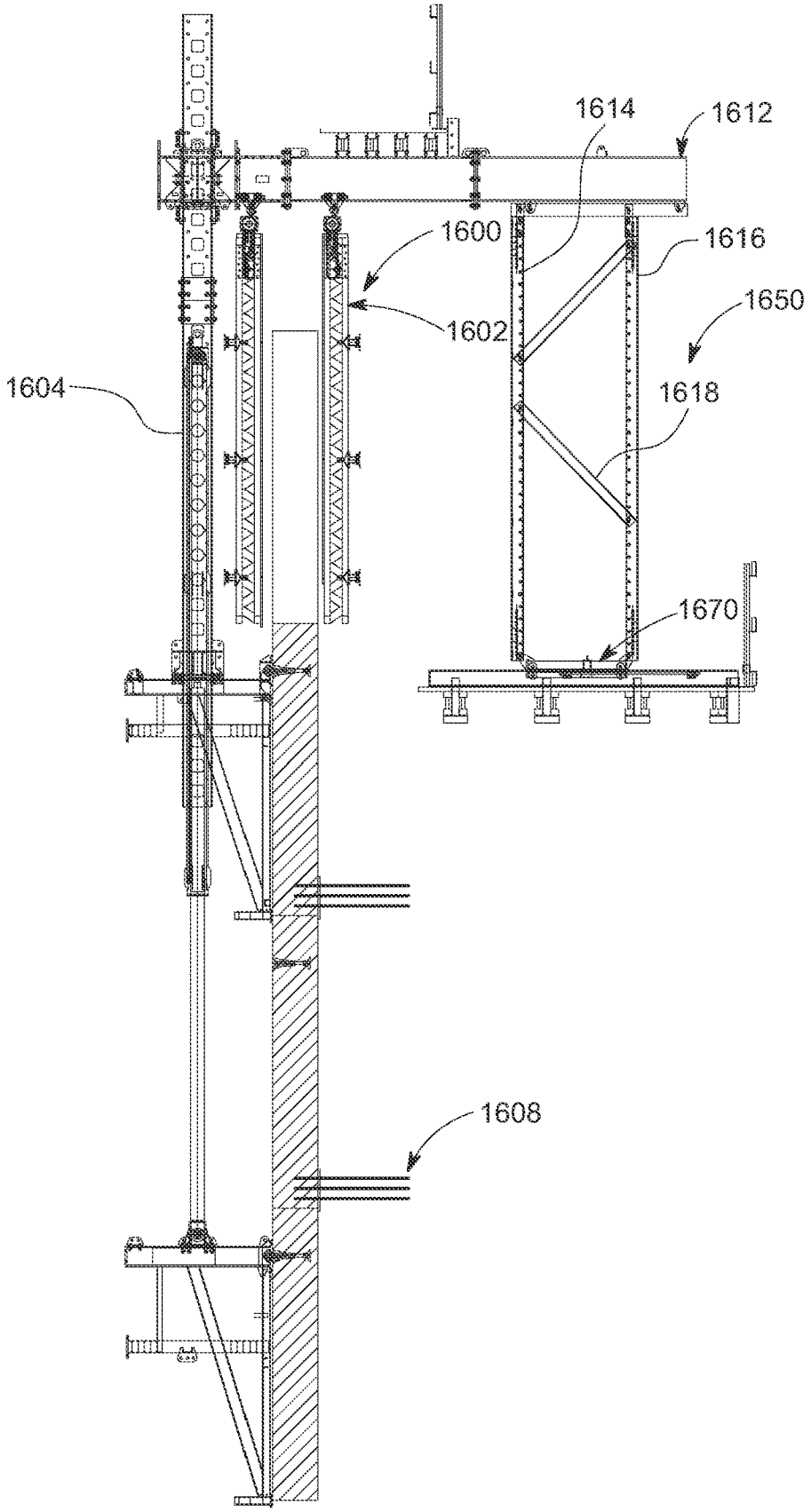
FIG. 21 depicts the working bracket being attached to anchors that were installed into the wall section.

FIG. 21 depicts the working bracket 1660, having been removed from wall section 1610*a*, being attached to anchors 1662 that were installed into the wall section 1606*a*.

Figure 22:
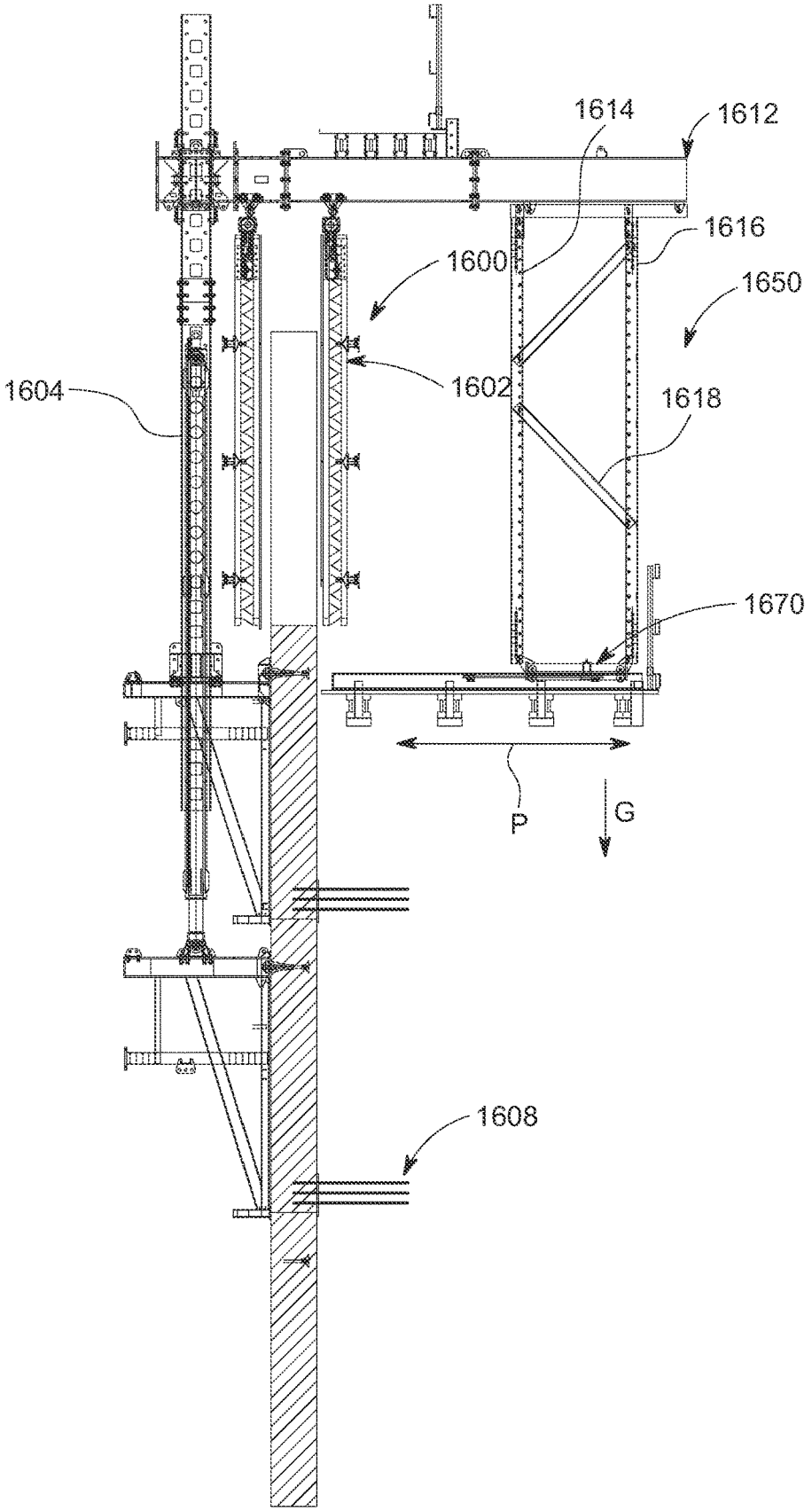
FIG. 22 depicts translation of the platform from a climbing position back to the working position.

FIG. 22 depicts translation of the platform 1620 from the climbing position back to the working position. In one example, the interlinkage 1618 can be actuated or manipulated to move the platform 1620 back to the working position. In doing so, the platform translates substantially along the translation plane P and the working surface 1620*a* of the platform 1620 is substantially coplanar to the working surface 1620*a* shown in the climbing position of FIGS. 18-21. Stated another way, the working surface 1620*a* remains substantially orthogonal to the gravity vector during translation from the climbing position back to the working position. Stated yet another way, the platform 1620 and the working surface 1620*a* are substantially level before, during, and after the translation from the climbing position to the working position. Further, the working surface 1620*a* maintains a constant area throughout.

Figure 23:
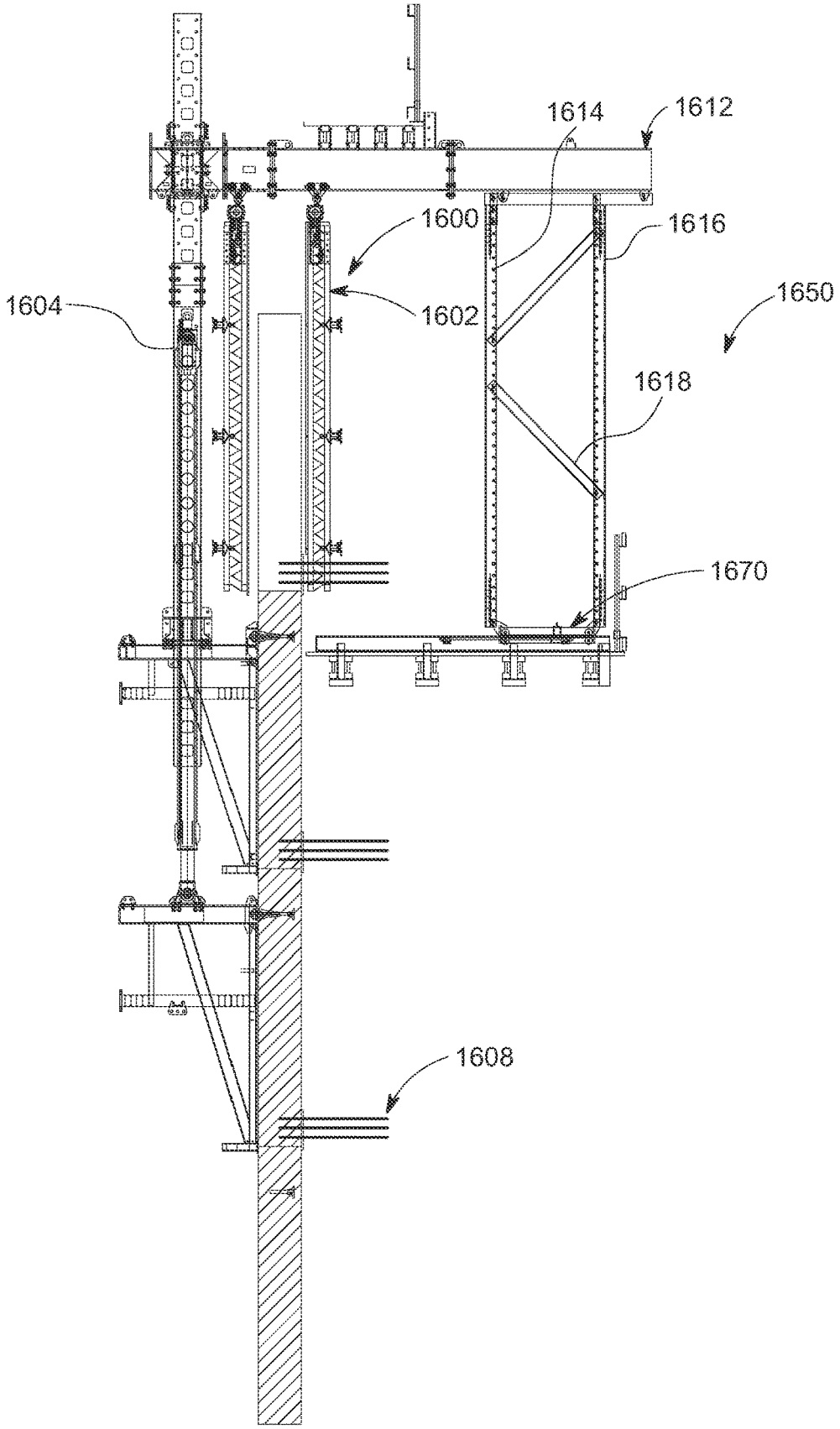
FIG. 23 depicts a preparation of formwork elements and placement of connection reinforcement elements for a subsequent concrete pour.

FIG. 23 depicts a preparation of formwork elements 1602, 1604 and placement of connection reinforcement elements 1608 for a subsequent concrete pour 1690.

Figure 24:
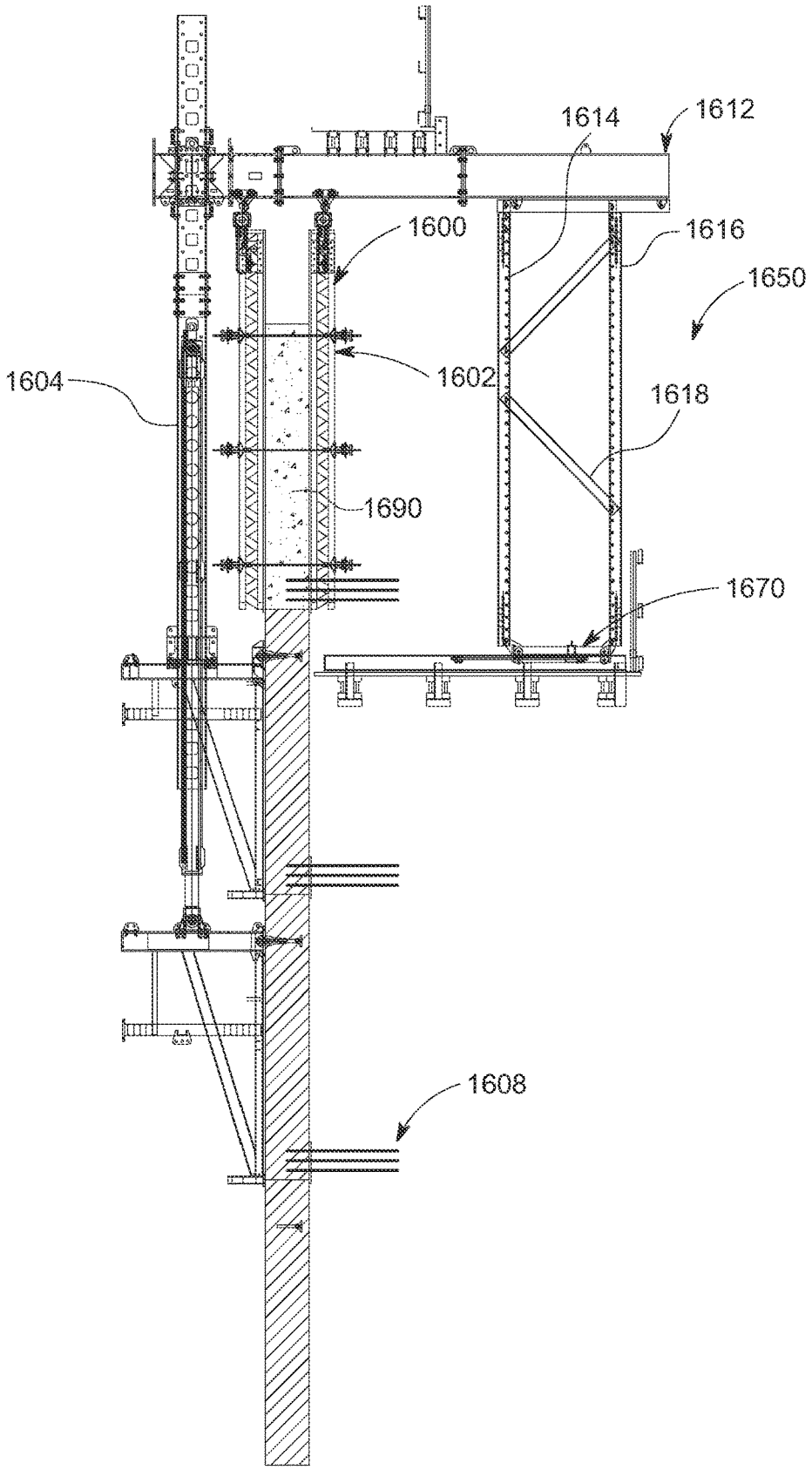
FIG. 24 depicts a subsequent pouring of fresh concrete.

FIG. 24 depicts a subsequent pouring of fresh concrete 1690, returning to the stage depicted in FIG. 1.

Although not depicted, it is contemplated that the system(s), process(es), and method(s) of FIGS. 16-24 are operable in any environment with varying width wall sections, such as those depict in FIGS. 10-15.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example a potential application where these embeds have their connection tabs protruding through the form face, which would save time and labor by not having to weld them in-field. Accordingly, this description is meant to be taken only by way of example, and not to otherwise limit the scope of this invention.

What is claimed is:

1. A method of forming a wall section using a formwork assembly and an external platform system, comprising:

suspending a platform from one or more overhead support structures, the one or more overhead supports comprising at least one of a gallows beam or a support beam;

attaching a working bracket to an existing wall section;

attaching the working bracket to the overhead support structure such that the working bracket supports the overhead support structure;

positioning a plurality of formwork elements of the formwork assembly to define an intermediate space for receiving fresh concrete;

positioning a connection reinforcement element in the intermediate space defined by the formwork assembly such that the connection reinforcement element projects outwardly with respect to at least one of the plurality of formwork elements;

pouring fresh concrete into the intermediate space defined by the plurality of formwork elements of the formwork assembly;

actuating a linear actuator by a user positioned on a working surface of the platform or at a position remote from the platform;

in response to the actuating of the linear actuator, translating the platform away from the plurality of formwork elements from a working position to a climbing position such that the working surface of the platform maintains a constant area, the working surface remains level throughout the translation, and the connection reinforcement element is clear of a vertical climbing path of the platform; and climbing the external platform system.

2. The method of claim 1, wherein the translation of the platform is one of: linear translation; or translation along a translation arc.

3. The method of claim 1, wherein the platform is configured to support a load, the load comprising one or more workers.

4. The method of claim 1, wherein actuating the linear actuator causes lengthening or shortening of the linear actuator.

5. The method of claim 1, wherein the plurality of linkages are removably connected to the linear actuator.

6. The method of claim 1, wherein the connection reinforcement element comprises a plurality of connection reinforcement elements.

7. The method of claim 6, wherein the plurality of connection reinforcement comprise a plurality of reinforcement bars having one of: a bow-shape or a U-shape.

8. The method of claim 1, wherein the working bracket is attached to the existing wall section by one or more anchors.

9. The method of claim 1, wherein the platform is suspended from the one or more overhead support structures by a plurality of linkages connected to the one or more overhead support structures by pivoting connections.

10. The method of claim 1, wherein actuating the linear actuator causes a decrease in length of the linear actuator, resulting in translation of the platform away from the plurality of formwork elements from the working position to the climbing position.

11. The method of claim 3, wherein the plurality of linkages are synchronized during translation of the platform away from the plurality of formwork elements from the working position to the climbing position.

12. The method of claim 1, further comprising:

after the external platform system is climbed and the connection reinforcement element is cleared, translating the platform toward from the plurality of formwork elements from the climbing position to the working position such that the working surface of the platform maintains a constant area and the working surface remains level throughout the translation.

* * * * *